US012365506B2

(12) United States Patent
Lane et al.

(10) Patent No.: US 12,365,506 B2
(45) Date of Patent: Jul. 22, 2025

(54) CONTAINER FOR DISPENSING FLEXIBLE SHEET PRODUCT AND ASSOCIATED BLANK

(71) Applicant: INTERNATIONAL PAPER COMPANY, Memphis, TN (US)

(72) Inventors: Jack Lawrence Lane, Southaven, MS (US); Charles Aaron Alexander, Hernando, MS (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 121 days.

(21) Appl. No.: 18/333,938

(22) Filed: Jun. 13, 2023

(65) Prior Publication Data

US 2024/0417130 A1 Dec. 19, 2024

(51) Int. Cl.

| | |
|---|---|
| ***B65D 5/16*** | (2006.01) |
| ***B65D 5/42*** | (2006.01) |
| ***B65D 5/468*** | (2006.01) |

(52) U.S. Cl.

CPC ..... *B65D 5/16* (2013.01); *B65D 5/4266* (2013.01); *B65D 5/4608* (2013.01)

(58) Field of Classification Search

CPC ..... B65D 5/722; B65D 2571/0066; B65D 2571/0058; B65D 5/16; B65D 5/4266; B65D 5/4608; B65D 5/542; B65D 83/08; B65D 5/725

USPC ..... 229/122, 143, 117.17, 123, 243, 242; 206/45.29, 759, 774; 221/305

See application file for complete search history.

(56) References Cited

U.S. PATENT DOCUMENTS

| | | | | |
|---|---|---|---|---|
| 1,114,042 | A * | 10/1914 | Richardson | B65D 71/36 229/162.1 |
| 2,968,431 | A * | 1/1961 | Pellaton | B65D 5/16 229/230 |
| 3,747,833 | A | 7/1973 | Robinson | |
| 4,244,254 | A | 1/1981 | Fish | |
| 4,340,170 | A | 7/1982 | Montealegre | |
| 4,382,510 | A | 5/1983 | Gaffney | |
| 4,621,766 | A * | 11/1986 | McClure | B65D 5/6632 229/117.17 |
| 5,794,770 | A | 8/1998 | Plomgren et al. | |
| 7,762,394 | B2 | 7/2010 | Bradford et al. | |
| 7,909,168 | B2 | 3/2011 | Virvo | |
| 7,967,154 | B1 | 6/2011 | Sharon | |
| 8,328,079 | B2 | 12/2012 | Kohler | |

(Continued)

FOREIGN PATENT DOCUMENTS

| | | | |
|---|---|---|---|
| DE | 202005012289 | U1 | 10/2005 |
| EP | 0876963 | A1 | 6/2004 |

(Continued)

*Primary Examiner* — Christopher R Demeree

(74) *Attorney, Agent, or Firm* — Rebecca M. Greendyke; Thomas W. Ryan; Clifford R. Lamar, II

(57) ABSTRACT

A container including a drop panel to facilitate dispensing of material from the container and a blank for forming the container. The drop panel is formed from a portion of an end panel alone or a portion of the end panel and an entirety of a top flange. When the container is assembled, a dispensing ledge is formed by folding the drop panel toward an outside of the container and connecting a top drop panel edge to an outer surface of the container. Also provided is a method of forming a dispensing ledge in a container.

28 Claims, 14 Drawing Sheets

(56) References Cited

U.S. PATENT DOCUMENTS

| | | | | |
|---|---|---|---|---|
| 9,169,039 | B2 * | 10/2015 | Freeman | B65D 5/722 |
| 11,993,433 | B2 * | 5/2024 | Bevier | B65D 5/16 |
| 2003/0098344 | A1 * | 5/2003 | Blake | B65D 5/524 229/243 |
| 2006/0071058 | A1 * | 4/2006 | Spivey | B65D 71/36 229/242 |
| 2007/0134371 | A1 | 6/2007 | Billig et al. | |
| 2013/0313158 | A1 * | 11/2013 | Nowak | B65D 5/542 206/774 |
| 2016/0052664 | A1 * | 2/2016 | Ward, Jr. | B65D 5/548 229/143 |
| 2020/0324933 | A1 | 10/2020 | Greenfeld | |

FOREIGN PATENT DOCUMENTS

| | | | |
|---|---|---|---|
| EP | 1301407 | B1 | 3/2006 |
| EP | 3971100 | A1 | 3/2022 |
| NL | 1010796 | C1 | 6/2000 |

* cited by examiner

CONTAINER FOR DISPENSING FLEXIBLE SHEET PRODUCT AND ASSOCIATED BLANK

FIELD OF THE DISCLOSURE

This disclosure relates generally to containers formed from a blank for shipping and dispensing a material, such as a flexible sheet product. More particularly, the disclosure relates to a container having a drop panel to facilitate dispensing of material from the container.

BACKGROUND

The typical manner for packaging and shipping bulk flexible sheet product, such as single-face corrugated paper, is to wrap the product around core tubes and ship it on rolls. Because the rolls typically hold hundreds of feet of material, they are large, heavy, and unwieldy and frequently require specially-provisioned trucks and devices for handling, making for complicated logistics operations to load, ship, and unload the rolls and then dispense the material. The product may also be damaged during shipping, unloading, and/or installation due to the size and weight of the rolls. Once the rolls have arrived at a customer's facility, the product is typically fed into a machine where the product is customized to the preferred application, such as for use as packaging material. In some instances, a portion of the product adjacent to the core tube may be tightly curled, rendering this portion unusable. In addition, once the product has been used up, the core tube generally requires special handling for disposal, as the core tubes cannot be reused and are generally unsuitable for normal recycling or waste streams.

SUMMARY

In accordance with a first aspect of the present disclosure, a container is provided, the container comprising: a first and a second side panel, a first and a second end panel, a plurality of top flanges, and a plurality of bottom flanges, in which the panels and flanges are connected to define the container; and a drop panel comprising a portion of the first end panel and an entirety of a first top flange of the plurality of top flanges. The first top flange is connected to the first end panel along a first end panel fold line, with the portion of the first end panel being defined by the first end panel fold line and: a second end panel fold line extending from a first longitudinal edge to a second longitudinal edge of the first end panel, the second end panel fold line being located between and spaced apart from the first end panel fold line and a lateral edge of the first end panel, and a first and a second precut edge defined by respective portions of the first and second longitudinal edges of the first end panel, the first and the second precut edge each extending from the second end panel fold line toward the first end panel fold line. The first end panel further comprises a third end panel fold line extending from the first longitudinal edge to the second longitudinal edge, with the third end panel fold line being located between and spaced apart from the first and the second end panel fold lines. The first end panel defines a first end of the container. When the container is assembled, a dispensing ledge is formed by folding the drop panel about the first, second, and third end panel fold lines toward an outside of the container and connecting a top drop panel edge to an outer surface of the first end of the container. The dispensing ledge is defined by a ledge portion extending between the second and third end panel fold lines. The dispensing ledge extends substantially perpendicular to the first end of the container.

The top drop panel edge may comprise one or more tabs that are received in one or more slots formed in a remaining portion of the first end panel to attach the top drop panel edge to the outer surface of the first end of the container.

The first end panel may further comprise a first and a second line of separation defined along respective portions of the first and second longitudinal edges, with the first line of separation extending from the first end panel fold line to the first precut edge and the second line of separation extending from the first end panel fold line to the second precut edge. The dispensing ledge may be formed by separating the first end panel from adjacent portions of the first and second side panels along the first and second lines of separation. The first end panel may comprise finger notches located adjacent to the first and second lines of separation.

One or more of the first side panel, the second side panel, the first end panel, and the second end panel may comprise at least one grasping opening that is shaped to allow for handling of the container.

The first top flange may comprise a fourth end panel fold line extending from a first longitudinal edge to a second longitudinal edge, with the fourth end panel fold line being spaced inward from a top edge of the first top flange. After the top drop panel edge is connected to the outer surface of the first end of the container, an outer surface of a portion of the drop panel extending between the fourth end panel fold line and the top drop panel edge may contact the outer surface of the first end of the container.

In accordance with a second aspect of the present disclosure, a method of forming a dispensing ledge in a container is provided. The container comprises a first and a second side, a first and a second end, a top, a bottom, and a drop panel, in which the first and second ends are defined by respective first and second end panels, the top is defined by a plurality of top flanges, the bottom is defined by a plurality of bottom flanges, and the drop panel comprises a portion of the first end panel and an entirety of a first top flange of the plurality of top flanges. The method comprises removing the drop panel from an inside of the container by folding the drop panel about a first and a second end panel fold line toward an outside of the container. The first top flange is connected to the first end panel along the first end panel fold line. The second end panel fold line is located between and spaced apart from the first end panel fold line and a lateral edge of the first end panel and extends from a first longitudinal edge to a second longitudinal edge of the first end panel. A portion of the first and second longitudinal edges of the first end panel extending from the second end panel fold line toward the first end panel fold line comprises a first and a second precut edge, respectively. The first and second precut edges are unconnected to adjacent portions of the first and second sides of the container. The method further comprises folding the drop panel about a third end panel fold line toward the first end of the container, in which the third end panel fold line extends from the first longitudinal edge to the second longitudinal edge of the first end panel and is located between and spaced apart from the first and the second end panel fold lines. The method may further comprise attaching a top drop panel edge to an outer surface of the first end to form a dispensing ledge, with the dispensing ledge being defined by a ledge portion extending between the second and third end panel fold lines. The dispensing ledge extends substantially perpendicular to the first end of the container.

The top drop panel edge may comprise one or more tabs and the first end of the container may comprise one or more slots formed in a remaining portion of the first end panel. Attaching the top drop panel edge to the outer surface of the first end may comprise inserting the one or more tabs into the one or more slots.

The first end panel may further comprise a first line of separation extending from the first end panel fold line to the first precut edge and a second line of separation extending from the first end panel fold line to the second precut edge. Removing the drop panel from the inside of the container may further comprise separating the first end panel from adjacent portions of the first and second sides along the first and second lines of separation. The first end panel may comprise finger notches located adjacent to the first and second lines of separation.

The first top flange may comprise a fourth end panel fold line extending from the first longitudinal edge to the second longitudinal edge, with the fourth end panel fold line being spaced inward from a top edge of the first top flange. Attaching the top drop panel edge to the outer surface of the first end of the container may further comprise folding the drop panel about the fourth end panel fold line, such that after the top drop panel edge is attached to the outer surface of the first end of the container, an outer surface of a portion of the drop panel extending between the fourth end panel fold line and the top drop panel edge may contact the outer surface of the first end of the container.

In accordance with a third aspect of the present disclosure a blank for forming a container is provided, the blank comprising: a first end panel and a second end panel each having opposing longitudinal edges and opposing lateral edges; a first side panel hingedly connected to one of the longitudinal edges of the first end panel and one of the longitudinal edges of the second end panel; a second side panel hingedly connected to the other of the longitudinal edges of the first end panel; a plurality of top flanges; and a plurality of bottom flanges. A first top flange of the plurality of top flanges is hingedly connected to one of the lateral edges of the first end panel along a first end panel fold line. The first end panel comprises a second end panel fold line extending between the opposing longitudinal edges thereof, with the second end panel fold line being located between and spaced apart from the first end panel fold line and a first lateral edge of the opposing lateral edges of the first end panel; a third end panel fold line extending between the opposing longitudinal edges thereof, with the third end panel fold line being located between and spaced apart from the first and the second end panel fold lines; and a first and a second precut edge defined by respective portions of the opposing longitudinal edges thereof, with the first and the second precut edge each extending from the second end panel fold line toward the first end panel fold line. The opposing longitudinal edges of the first end panel are unconnected to the first and second side panels along the first and second precut edges.

A top edge of the first top flange may comprise one or more tabs foldably connected to the first top flange, and the first end panel may comprise one or more slots formed between the second end panel fold line and the first lateral edge of the first end panel.

The first end panel further may comprise a first and a second line of separation defined by respective portions of the opposing longitudinal edges of the first end panel, with the first line of separation extending from the first end panel fold line to the first precut edge and the second line of separation extending from the first end panel fold line to the second precut edge. The first end panel may further comprise finger notches extending inward from the opposing longitudinal edges thereof, in which the finger notches may be located adjacent to the first and second lines of separation.

The first top flange may comprise a fourth end panel fold line extending between opposing longitudinal edges thereof, the fourth end panel fold line being spaced inward from a top edge of the first top flange.

In accordance with a fourth aspect of the present disclosure, a container is provided, the container comprising: a first and a second side panel, a first and a second end panel, a plurality of top flanges, and a plurality of bottom flanges, in which the panels and flanges are connected to define the container; and a drop panel comprising a portion of the first end panel. The drop panel is defined by: a first line of separation extending from a first longitudinal edge to a second longitudinal edge of the first end panel, with the first line of separation being spaced apart from a first lateral edge of the first end panel; a first end panel fold line extending from the first longitudinal edge to the second longitudinal edge, with the first end panel fold line being spaced apart from a second lateral edge of the first end panel; and a second line of separation and a third line of separation defined along respective portions of the first and second longitudinal edges of the first end panel, in which the second and third lines of separation each extend from the first line of separation to the first end panel fold line. The first end panel further comprises one or more additional end panel fold lines extending from the first longitudinal edge to the second longitudinal edge, with each of the one or more additional end panel fold lines being located between and spaced apart from the first line of separation and the first end panel fold line. The first end panel defines a first end of the container. When the container is assembled, a dispensing ledge is formed by separating the drop panel along the first, second, and third lines of separation, folding the drop panel about the first end panel fold line and the one or more additional end panel fold lines, and attaching a top drop panel edge to an outer surface of the first end of the container. The dispensing ledge is defined by a ledge portion extending between the first end panel fold line and an adjacent one of the one or more additional end panel fold lines.

The top drop panel edge may comprise one or more tabs that are received in one or more slots formed in a remaining portion of the first end panel to attach the top drop panel edge to the outer surface of the first end of the container.

The drop panel may comprise finger notches located adjacent to the first, second, and third lines of separation.

After the top drop panel edge is attached to the outer surface of the first end of the container, an outer surface of a portion of the drop panel extending between the top drop panel edge and an adjacent one of the one or more additional end panel fold lines may contact the outer surface of the first end of the container.

In accordance with a fifth aspect of the present disclosure, a method of forming a dispensing ledge in a container is provided. The container comprises a first and a second side, a first and a second end, a top, a bottom, and a drop panel, in which the first and second ends are defined by respective first and second end panels, the top is defined by a plurality of top flanges, the bottom is defined by a plurality of bottom flanges, and the drop panel comprises a portion of the first end panel. The method comprises detaching the drop panel from the container along a first, a second, and a third line of separation, in which the first line of separation extends from a first longitudinal edge to a second longitudinal edge of the first end panel and is spaced apart from a first lateral edge of the first end panel and in which the second and third lines of separation are defined along respective portions of the first and second longitudinal edges of the first end panel and each extend from the first line of separation to a first end panel fold line. The first end panel fold line extends from the first longitudinal edge to the second longitudinal edge of the first end panel and is spaced apart from a second lateral edge of the first end panel. The method further comprises folding the drop panel about the first end panel fold line and one or more additional end panel fold lines toward the first end of the container, in which the one or more additional end panel fold lines each extend from the first longitudinal edge to the second longitudinal edge of the first end panel and are spaced apart from the first line of separation and the first end panel fold line. The method further comprises attaching a top drop panel edge to an outer surface of the first end of the container to form a dispensing ledge, with the dispensing ledge being defined by a ledge portion extending between the first end panel fold line and an adjacent one of the one or more additional end panel fold lines.

The top drop panel edge may comprise one or more tabs and the first end of the container may comprise one or more slots formed in a remaining portion of the first end panel. Attaching the top drop panel edge to the outer surface of the first end may comprise inserting the one or more tabs into the one or more slots.

The first end panel may comprise finger notches located adjacent to the first, second, and third lines of separation.

After the top drop panel edge is attached to the outer surface of the first end of the container, the drop panel may fold about one of the one or more additional end panel fold lines adjacent to the top drop panel edge, such that an outer surface of a portion of the drop panel extending between the one additional end panel fold line and the top drop panel edge may contact the outer surface of the first end of the container.

The one or more additional end panel fold lines may comprise a plurality of additional end panel fold lines, and folding the drop panel about the plurality of additional end panel fold lines and attaching the top drop panel edge to the outer surface of the first end of the container may create a curved section of the drop panel that extends outward from the first end of the container.

In accordance with a sixth aspect of the present disclosure, a blank for forming a container is provided, the blank comprising: a first end panel and a second end panel each having opposing first and second longitudinal edges and opposing first and second lateral edges; a first side panel hingedly connected to one of the longitudinal edges of the first end panel and one of the longitudinal edges of the second end panel; a second side panel hingedly connected to the other of the longitudinal edges of the first end panel; a plurality of top flanges; and a plurality of bottom flanges. A first top flange of the plurality of top flanges comprises a first line of separation extending between the first and second longitudinal edges thereof, with the first line of separation being spaced apart from the first lateral edge; a first end panel fold line extending between the first and second longitudinal edges thereof, with the first end panel fold line being spaced apart from the second lateral edge; a second line of separation and a third line of separation defined along respective portions of the first and second longitudinal edges thereof, in which the second and third lines of separation each extend from the first line of separation to the first end panel fold line; and one or more additional end panel fold lines each extending from the first longitudinal edge to the second longitudinal edge thereof, in which the at least one additional end panel fold lines are located between and spaced apart from the first line of separation and the first end panel fold line.

A top edge of the first top flange may comprise one or more tabs foldably connected to the first top flange and the first end panel may comprise one or more slots formed between the first end panel fold line and the first lateral edge of the first end panel.

The first end panel may further comprise finger notches located adjacent to the first, second, and third lines of separation.

DETAILED DESCRIPTION

In the following detailed description of the preferred embodiments, reference is made to the accompanying drawings that form a part hereof, and in which is shown by way of illustration, and not by way of limitation, specific preferred embodiments in which the blanks and containers in accordance with the present disclosure may be practiced. It is to be understood that other embodiments may be utilized and that changes may be made without departing from the spirit and scope of the present disclosure.

The present disclosure is directed to a container comprising a one-piece blank that is folded to form a container in accordance with the present disclosure. The container may be used to store, ship, and dispense a bulk flexible sheet product, such as single-face corrugated paper, in order to address the logistical challenges and inefficiencies presented by supplying the product as rolls. The flexible sheet product may be layered into the contemplated container, permitting up to hundreds of feet of the product to reside within each individual container. The container may then be shipped, during which the container would serve as protection for the enclosed product without requiring the use of core tubes, rolls, or specialized roll-carriage devices. Throughout the loading, shipping, and unloading process, the container in accordance with the present disclosure may permit easier handling and transportation of the product, as compared to handling of the product on rolls. The containers may be stacked to maximize usage of space during shipping.

The container in accordance with the present disclosure comprises a partially-detachable drop panel to convert the container into a dispenser for the bulk flexible sheet product, permitting the product to smoothly and easily dispense from the container after assembly. The product may be arranged in the container such that substantially all of the product is usable. The container may be formed from a blank processed either with conventional equipment designed for this purpose or set up by hand. For example, the blank may be folded and/or closed using currently available case forming equipment to form the container, or the container may be formed through manually executed steps, or through a combination of machine-implemented and manual steps. The container may be made from corrugated fibreboard or other paperboard material, such that when the product is used up, the container may be reused, repurposed, or placed into normal recycling or waste streams.

Figure 1A:
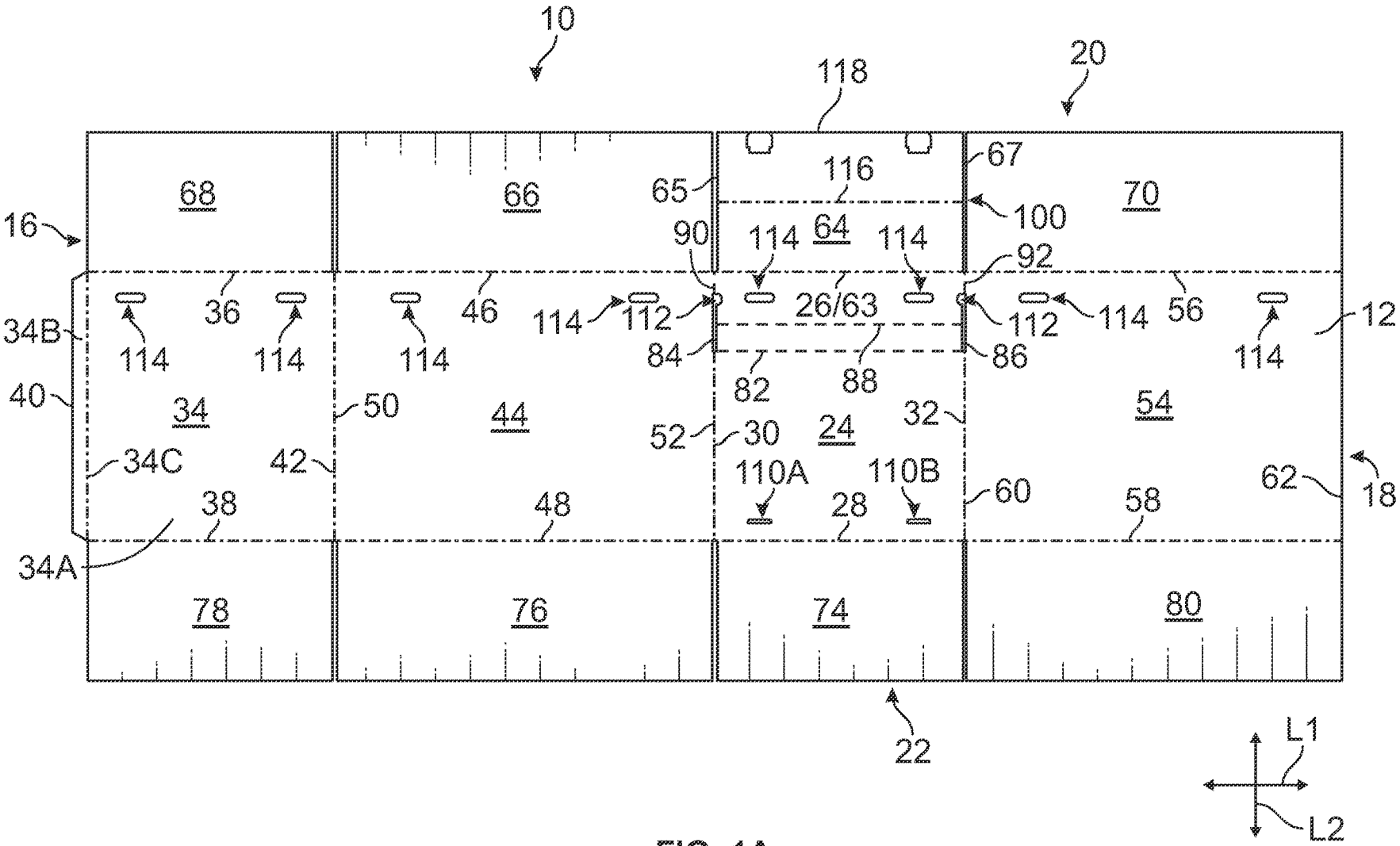
FIG. 1A is a plan view of an exemplary blank for forming a container, in accordance with the present disclosure.

Referring to FIG. 1A, a one-piece blank 10 is shown, from which an exemplary container 200 may be formed, as described herein (see FIGS. 2-5). The blank 10 may be formed of corrugated fibreboard or other paperboard material and may be die cut to the shape shown herein, although other materials and variations of the illustrated shape may be provided within the scope of the blanks and containers described and claimed herein. The blank 10 illustrated in FIG. 1A is a planar piece of material, in which an inner surface 12 is shown facing out of the page and an outer surface 14 (see FIG. 2) is facing an opposite direction from the inner surface 12. The blank 10 extends in a longitudinal direction $L_1$ between first and second longitudinal ends, generally designated 16 and 18, respectively, and further extends in a lateral direction $L_2$ between first and second lateral edges, generally designated 20 and 22, respectively.

The blank 10 comprises a plurality of panels connected at respective fold lines, in which fold lines are represented by a dash-dot line. The blank 10 may comprise a first end panel 24 having opposing first and second lateral edges 26 and 28 and opposing first and second longitudinal edges 30 and 32, and a second end panel 34 having opposing first and second lateral edges 36 and 38 and opposing first and second longitudinal edges 40 and 42. The second end panel 34 may comprise a main end panel 34A and a glue flap 34B coupled to a longitudinal edge 34C of the main end panel 34A along a fold line. The blank 10 may further comprise a first side panel 44 having opposing first and second lateral edges 46 and 48 and opposing first and second longitudinal edges 50 and 52, in which the second longitudinal edge 52 is hingedly connected to the first longitudinal edge 30 of the first end panel 24 along a fold line and the first longitudinal edge 50 is hingedly connected to the second longitudinal edge 42 of the second end panel 34 along a fold line. The blank 10 may further comprise a second side panel 54 having opposing first and second lateral edges 56 and 58 and opposing first and second longitudinal edges 60 and 62, in which the first longitudinal edge 60 is hingedly connected to the second longitudinal edge 32 of the first end panel 24 along a fold line.

With continued reference to FIG. 1A, a first top flange 64 may be hingedly connected to the first end panel 24 along a first end panel fold line 63 defined at the first lateral edge 26 of the first end panel 24 and extending longitudinally between opposing first and second longitudinal edges 65 and 67 of the first top flange 64. A second top flange 66 may be hingedly connected to the first side panel 44 along a fold line defined at the first lateral edge 46 of the first side panel 44. A third top flange 68 may be hingedly connected to the second end panel 34 along a fold line defined at the first lateral edge 36 of the second end panel 34. A fourth top flange 70 may be hingedly connected to the second side panel 54 along a fold line defined at the first lateral edge 56 of the second side panel 54.

A first bottom flange 74 may be hingedly connected to the first end panel 24 along a fold line defined at the second lateral edge 28 of the first end panel 24. A second bottom flange 76 may be hingedly connected to the first side panel 44 along a fold line defined at the second lateral edge 48 of the first side panel 44. A third bottom flange 78 may be hingedly connected to the second end panel 34 along a fold line defined at the second lateral edge 38 of the second end panel 34. A fourth bottom flange 80 may be hingedly connected to the second side panel 54 along a fold line defined at the second lateral edge 58 of the second side panel 54. The first and second end panels 24 and 34, the first and second side panels 44 and 54, the top flanges 64, 66, 68, and 70, and the bottom flanges 74, 76, 78, and 80 may be connected to define the container 200 (see FIG. 2), as described herein.

The first end panel 24 may include a score line defining a second end panel fold line 82 which extends longitudinally across the first end panel 24 from the first longitudinal edge 30 of the first end panel 24 to the second longitudinal edge 32 of the first end panel 24. Score lines are represented by a dashed line. The second end panel fold line 82 is located between and spaced laterally apart from the first end panel fold line 63 and the second lateral edge 28 of the first end panel 24.

Referring still to FIG. 1A, the first end panel 24 additionally may include a first and second precut edge, 84 and 86, respectively, defined by respective portions of the first and second longitudinal edges 30 and 32 of the first end panel 24. The first and the second precut edges 84 and 86 each extend from the second end panel fold line 82 toward the first end panel fold line 63 at the first lateral edge 26 of the first end panel 24. The first precut edge 84 and the second precut edge 86 may be defined by cut lines, e.g., clean cut lines that extend completely through the first end panel 24, in which the first and second longitudinal edges 30 and 32 of the first end panel 24 are unconnected to adjacent portions of the first and second side panels 44 and 54 along the first and second precut edges 84 and 86.

The first end panel 24 additionally may include a score line defining a third end panel fold line 88, which extends longitudinally across the first end panel 24 from the first longitudinal edge 30 of the first end panel 24 to the second longitudinal edge 32 of the first end panel 24. The third end panel fold line 88 is located between and spaced laterally apart from the first end panel fold line 63 and the second end panel fold line 82.

With continued reference to the example shown in FIG. 1A, a first and second line of separation, 90 and 92 respectively, may be defined along respective portions of the first and second longitudinal edges 30 and 32 of the first end panel 24. Lines of separation are represented by a dashed line. The first line of separation 90 extends laterally from the first end panel fold line 63 to the first precut edge 84, and the second line of separation 92 extends laterally from the first end panel fold line 63 to the second precut edge 86. The first and second lines of separation 90 and 92 may be defined by score lines, nicked cut lines, or perforation lines, such that a user can separate the first end panel 24 from adjacent portions of the first and second side panels 44 and 54 along the first and second lines of separation 90 and 92, as described herein. In other examples (not shown), the first and second precut edges 84 and 86 may be replaced with lines of separation, such that the first end panel 24 comprises lines of separation extending from the first end panel fold line 63 to the second end panel fold line 82.

The first top flange 64 may further comprise a fourth end panel fold line 116 extending from the first longitudinal edge 65 to the second longitudinal edge 67 of the first top flange 64. The fourth end panel fold line 116 is spaced laterally inward from a top edge 118 of the first top flange 64 and is spaced laterally apart from the first end panel fold line 63.

Figure 1B:
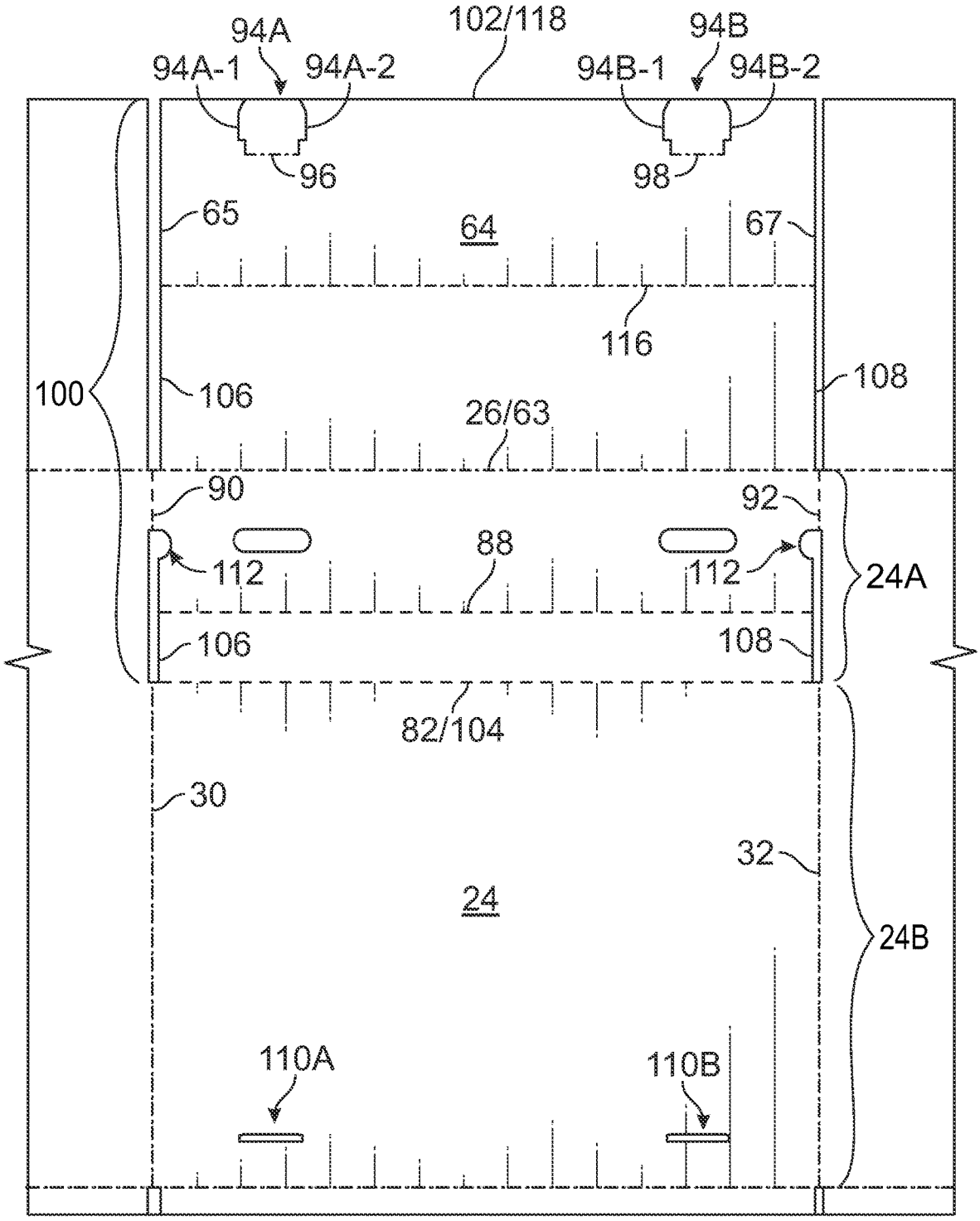
FIG. 1B is a detailed view of a portion of the blank of FIG. 1A.

Referring to the detailed view of FIG. 1B, the blank 10 may comprise a drop panel 100 which may be comprised of a portion 24A of the first end panel 24 and an entirety of the first top flange 64. The portion 24A of the first end panel 24 that comprises the drop panel 100 may be defined by the first end panel fold line 63, the second end panel fold line 82, and the portions of the first and second longitudinal edges 30 and 32 extending laterally between the first and second end panel fold lines 63 and 82, i.e., the first and second precut edges 84 and 86 and the first and second lines of separation 90 and 92. The drop panel 100 has opposing top and bottom lateral edges 102 and 104, in which the top lateral edge 102 (also referred to herein as the top drop panel edge) comprises and is defined by the top edge 118 of the first top flange 64 and the bottom lateral edge 104 comprises and is defined by the second end panel fold line 82. The drop panel 100 further has opposing first and second longitudinal edges 106 and 108, in which the first longitudinal edge 106 is comprised of and defined by a portion of the first longitudinal edge 30 of the first end panel 24 and an entirety of the first longitudinal edge 65 of the first top flange 64 and the second longitudinal edge 108 is comprised of and defined by a portion of the second longitudinal edge 32 of the first end panel 24 and an entirety of the second longitudinal edge 67 of the first top flange 64.

With continued reference to FIG. 1B, the first top flange 64 may include one or more tabs 94A and 94B extending inward from and foldably connected to the top edge 118 of the first top flange 64, i.e., the top drop panel edge 102. Each tab 94A and 94B defines a locking tab and is defined by two curved lines 94A-1, 94A-2 and 94B-1, 94B-2, respectively, which may be score lines, lines of separation, or cut lines and may extend generally laterally inward from the top edge 118, and a respective hinge connection 96 and 98 located laterally inward from the top edge 118 and extending longitudinally between inward ends (not labeled) of the respective lines 94A-1, 94A-2 and 94B-1, 94B-2. The first end panel 24 may further include one or more corresponding slots 110A and 110B formed in a remaining portion 24B of the first end panel 24 that does not define the drop panel 100, i.e., the portion 24B of the first end panel 24 located between the second end panel fold line 82 and the second lateral edge 28. The slots 110A and 110B may be configured to receive a respective one of the tabs 94A and 94B upon removal and folding of the drop panel 100, as described herein (see FIGS. 3-5).

One or more finger openings or notches 112 may optionally be provided in the first end panel 24 extending inward from the first and second longitudinal edges 30 and 32, as shown in FIGS. 1A and 1B. The first and second longitudinal edges 30 and 32 are unattached to the first and second side panels 44 and 54 in the areas defining the finger notches 112. The finger notches 112 may be located adjacent to the first and second lines of separation 90 and 92, e.g., between the first and second lines of separation 90 and 92 and the third end panel fold line 88, to facilitate separation of the first end panel 24 from adjacent portions of the first and second side panels 44 and 54 along the first and second lines of separation 90 and 92, as described herein.

One or more grasping openings 114 may optionally be provided in one or more of the first end panel 24, the second end panel 34, the first side panel 44, and the second side panel 54. The grasping opening(s) 114 may be shaped to allow for handheld carrying and handling of the assembled container 200.

Figure 2:
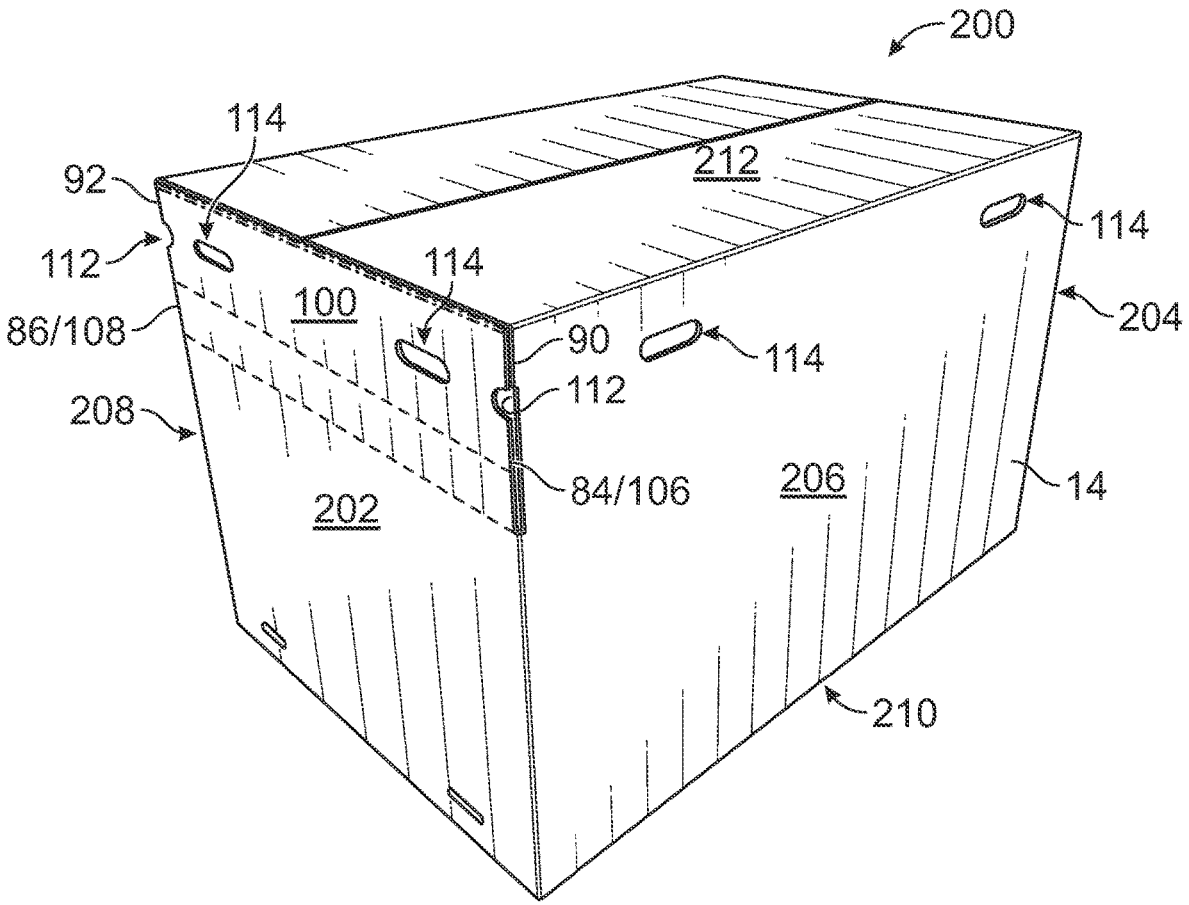
FIG. 2 is a perspective view of an exemplary assembled container, in accordance with the present disclosure.

Referring to FIGS. 1A and 2, a container 200 may be formed from the blank 10 by, for example, folding the second side panel 54 toward the first end panel 24 along the fold line at the first longitudinal edge 60 of the second side panel 54; folding the second end panel 34 toward the first side panel 44 along the fold line at the second longitudinal edge 42 of the second end panel 34; folding the second end panel 34 and the first side panel 44 together toward the first end panel 24 along the fold line at the second longitudinal edge 52 of the first side panel 44; and adhesively securing the glue flap 34B to the inner surface 12 of the blank 10 adjacent to the second longitudinal edge 62 of the second side panel 54. It may be understood that other folding sequences may be used to form the container 200. Thereafter, the container 200 may be partially erected such that the first end panel 24 extends generally 90 degrees to the first side panel 44 and the second side panel 54, the first side panel 44 extends generally 90 degrees to the second end panel 34, and the second end panel 34 extends generally 90 degrees to the second side panel 54. The first end panel 24 forms or defines a first end 202 of the container 200; the second end panel 34 forms or defines a second end 204 of the container 200 opposite the first end 202; the first side panel 44 forms or defines a first side 206 of the container 200; and the second side panel 54 forms or defines a second side 208 of the container 200 opposite the first side 206.

After the container 200 is partially erected, the first, second, third and fourth bottom flanges 74, 76, 78, and 80 may be folded inwardly so as to extend generally 90 degrees to the first and second end panels 24 and 34 and the first and second side panels 44 and 54. An exemplary sequence in which the first, second, third and fourth bottom flanges 74, 76, 78 and 80 are folded may be as follows: the first and third bottom flanges 74 and 78 are folded inwardly, after which the second and fourth bottom flanges 76 and 80 are folded over the first and third bottom flanges 74 and 78. Adhesive may be provided between adjacent overlapping portions of the bottom flanges 74, 76, 78 and 80 and/or tape may be used to secure the bottom flanges 74, 76, 78 and 80 in position. The bottom flanges 74, 76, 78 and 80 form or define a bottom 210 of the container 200.

The described container 200 may be filled with material such as a flexible sheet product that may be layered into the container 200, after the bottom flanges 74, 76, 78 and 80 have been folded and secured in position but before a top 212 of the container 200 is formed. Once the material has been added to the partially-constructed container 200, the first, second, third and fourth top flanges 64, 66, 68 and 70 may be folded inwardly so as to extend generally 90 degrees to the first and second end panels 24 and 34 and the first and second side panels 44 and 54. An exemplary sequence in which the first, second, third and fourth top flanges 64, 66, 68 and 70 are folded may be as follows: the first and third top flanges 64 and 68 are folded inwardly, after which the second and fourth top flanges 66 and 70 are folded over the first and third top flanges 64 and 68. Tape may be used to secure the top flanges 64, 66, 68 and 70 in position. The top flanges 64, 66, 68 and 70 form or define the top 212 of the container 200.

Figure 3:
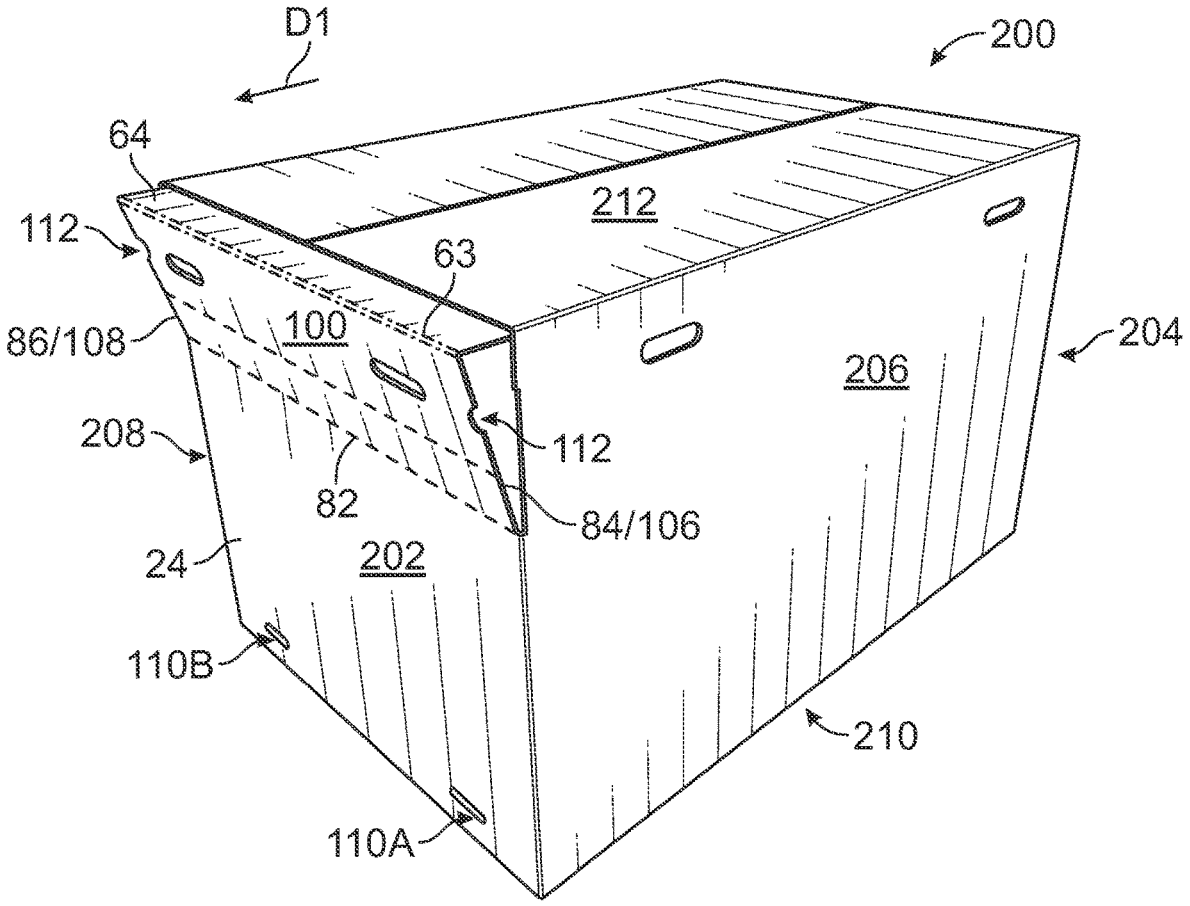
FIGS. 3 and 4 are perspective views illustrating the container of FIG. 2 with a partially assembled drop panel, in accordance with the present disclosure.

Once the container 200 is assembled and the material within the filled container 200 is ready to be dispensed, the container 200 may be opened by detaching or removing the drop panel 100 from the container 200, folding the drop panel 100, and then reattaching the drop panel 100 to the container 200. Referring to FIGS. 2 and 3, a user may grip the drop panel 100 at the longitudinal edges 106 and 108, e.g., via the precut edges 84 and 86 of the first end panel 24 and the finger notches 112 (when present), and pull the drop panel 100 away from the first and second sides 206 and 208 of the container 200, i.e., from an inside of the container 200 and toward an outside of the container 200. The precut edges 84 and 86 are unconnected to the adjacent sides 206 and 208 of the container 200, and the user may separate the longitudinal edges 106 and 108 of the drop panel 100 from adjacent portions of the first and second sides 206 and 208 (i.e., from the first and second side panels 44 and 54) along the first and second lines of separation 90 and 92. The finger notches 112 may assist the user with locating and grasping the longitudinal edges 106 and 108 of the drop panel 100.

Figure 4:
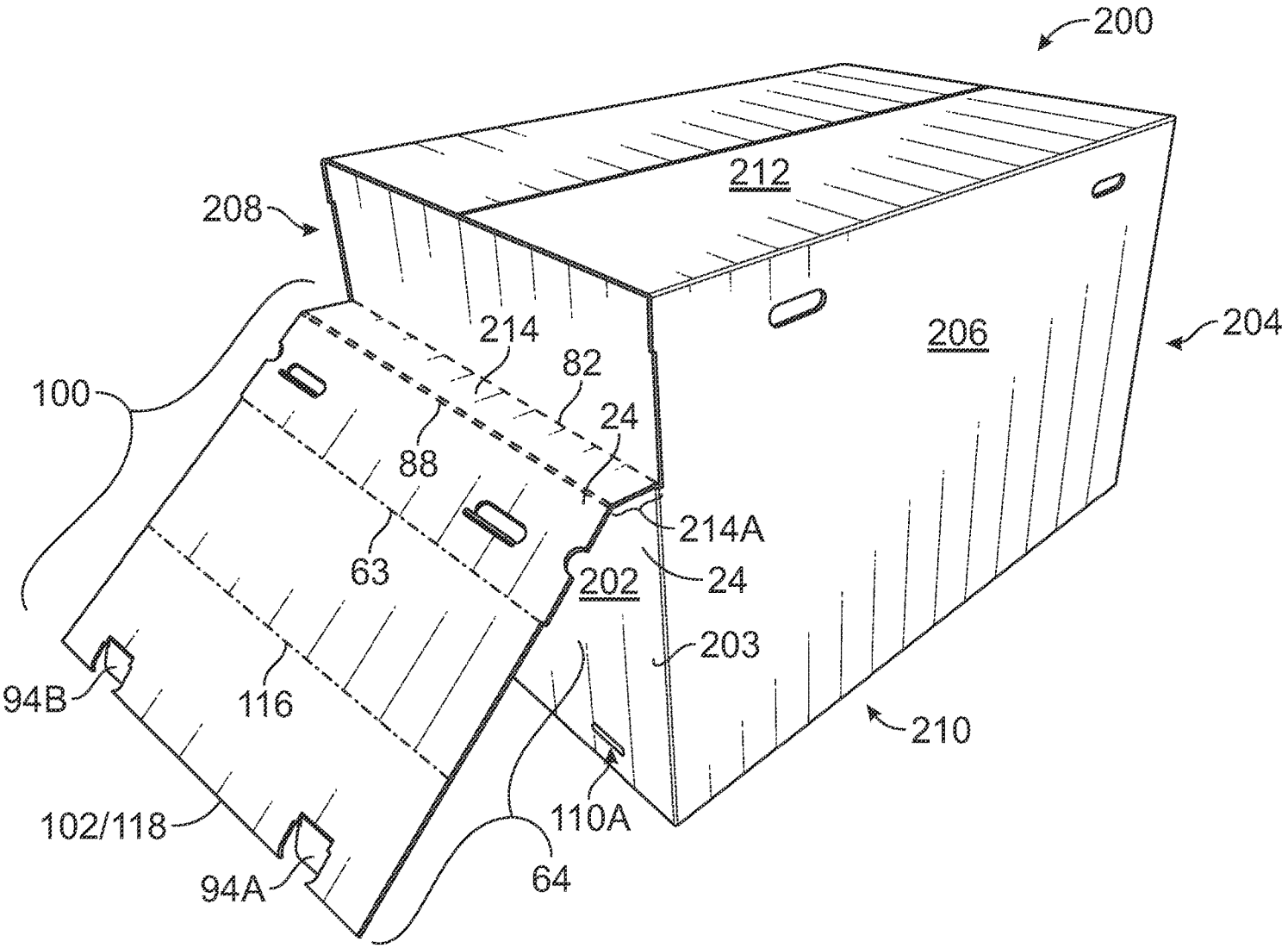

Referring to FIG. 3, once the drop panel 100 is separated along the lines of separation 90 and 92, the user may continue to slide the drop panel 100 away from the first and second sides 206 and 208 and the top 212 of the container 200, which causes a portion of drop panel 100 comprising the first top flange 64 to slide substantially parallel to the top 212 of the container 200 in a direction D1. The drop panel 100 folds along the first end panel fold line 63, such that the drop panel 100 also begins to fold outward along the second end panel fold line 82. Referring to FIG. 4, the user may continue pulling the drop panel 100 away from the first and second sides 206 and 208 and the top 212 of the container 200, until the portion of the drop panel 100 comprising the first top flange 64 and the top drop panel edge 102 is completely free from the top 212 and the first and second sides 206 and 208 of the container 200. During the process of removing the drop panel 100 from the container 200, the drop panel 100 may also flex or fold about one or more other fold lines, including the third and/or fourth end panel fold lines 88 and 116.

Figure 5:
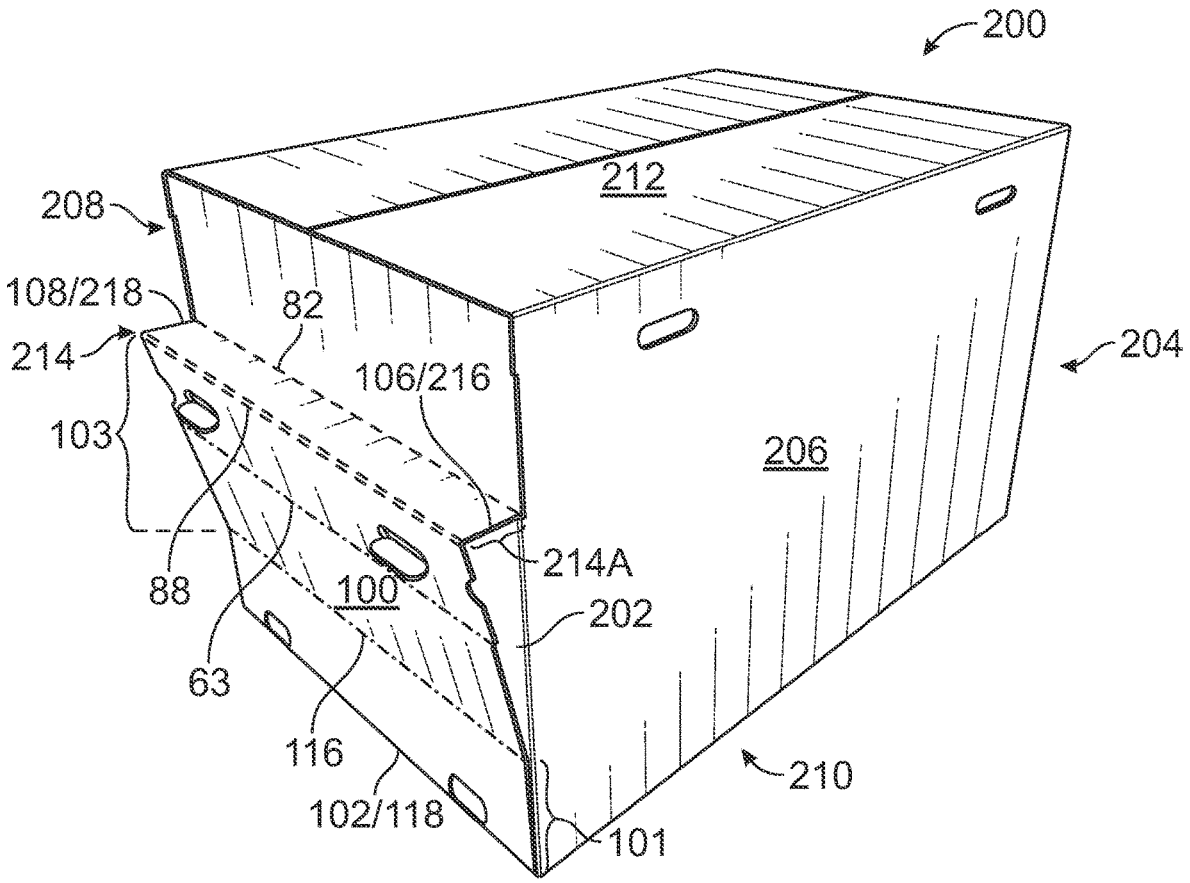
FIG. 5 is a perspective view illustrating the container of FIG. 4 with an assembled drop panel, in accordance with the present disclosure.

With reference to FIGS. 4 and 5, once the drop panel 100 is removed from the container 200, the user may form a dispensing ledge 214 by folding the drop panel 100 back toward the first end 202 of the container 200 about the third end panel fold line 88 and connecting or attaching the top drop panel edge 102 to an outer surface 203 of the first end 202 of the container 200, e.g., by inserting the tabs 94A and 94B formed in the top drop panel edge 102 into the slots 110A and 110B (only slot 110A is visible in FIG. 4; see FIG. 3) formed in the first end 202 of the container 200. Engagement between the tabs 94A and 94B and the slots 110A and 110B helps to lock the drop panel 100 in place. The dispensing ledge 214 is defined by a ledge portion 214A extending between the second and third end panel fold lines 82 and 88. The dispensing ledge 214 may have opposing inner and outer edges (not separately labeled) defined by the second and third end panel fold lines 82 and 88, respectively, and opposing side edges 216 and 218 defined by respective portions of the longitudinal edges 106 and 108 of the drop panel 100. After the dispensing ledge 214 is formed, the dispensing ledge 214 extends substantially perpendicular to, i.e., at an angle of about 90 degrees, ±5 degrees, with respect to the first end 202 of the container 200 and may extend substantially parallel to the top 212 and/or the bottom 210 of the container 200. The top drop panel edge 102 may be substantially aligned with a plane (not shown) defined by the bottom 210 of the container 200.

With reference to FIG. 5, when the top drop panel edge 102 is connected to the outer surface 203 of the first end 202 of the container 200, the drop panel 100 may fold about the fourth end panel fold line 116, such that an outer surface (not visible) of a portion 101 of the drop panel 100 extending between the fourth end panel fold line 116 and the top drop panel edge 102 contacts and is parallel with an adjacent or underlying portion of the outer surface 203 of the first end 202 of the container 200 and a portion 103 of the drop panel 100 extending between the third end panel fold line 88 and the fourth end panel fold line 116 extends at an angle of less than 90 degrees with respect to the first end 202 of the container 200.

Figure 6:
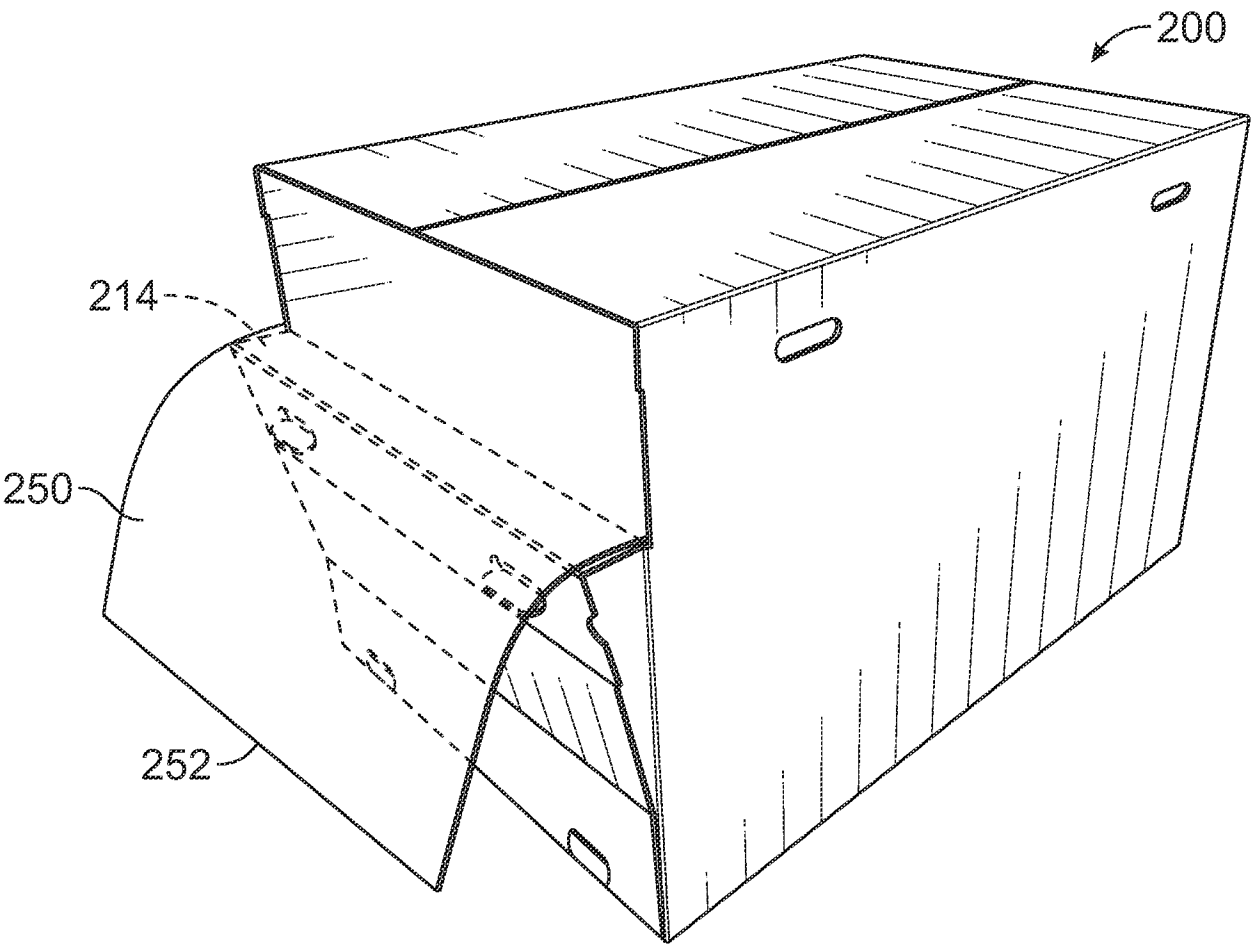
FIG. 6 is a perspective view illustrating a product being dispensed from the container of FIG. 5.

As shown in FIG. 6, after the container 200 is opened and the dispensing ledge 214 is formed, a product 250, such as a flexible sheet product, may be dispensed directly from the container 200 by grasping a first end 252 of the product 250 and pulling the product 250 out of the container 200. The first end 252 of the product 250 may be inserted into automated machinery that generates, for example, customized packaging material or other desired applications for the product 250. The dispensing ledge 214 supports the product 250, and the product 250 dispenses smoothly over the dispensing ledge 214, which may help to prevent tearing, jamming, or other damage to the product 250. The dispensing ledge 214 may also provide structural rigidity and stiffness to the first end 202 of the container 200, preventing false scores that could cause the first end 202 to bulge or collapse. In some examples, the container 200 may contain approximately 60% more of a flexible sheet product 250 than is typically provided in a conventional roll, which may help to reduce the number of times that the automated machinery must be stopped to replenish the product 250. The blank 10 and the container 200 formed therefrom may be sized to accommodate a product having any desired size. For example, although the blank 10 and the container 200 in FIGS. 1-6 are depicted as having side panels 44, 54 and sides 206, 208 having a greater dimension in the longitudinal direction $L_1$ than the end panels 24, 34 and ends 202, 204, it may be understood that the side panels 44, 54 and sides 206, 208 and the end panels 24, 34 and ends 202, 204 may have a substantially similar dimension or that the end panels 24, 34 and ends 202, 204 may have a greater dimension in the longitudinal direction $L_1$ than the side panels 44, 54 and sides 206, 208.

Figure 11:
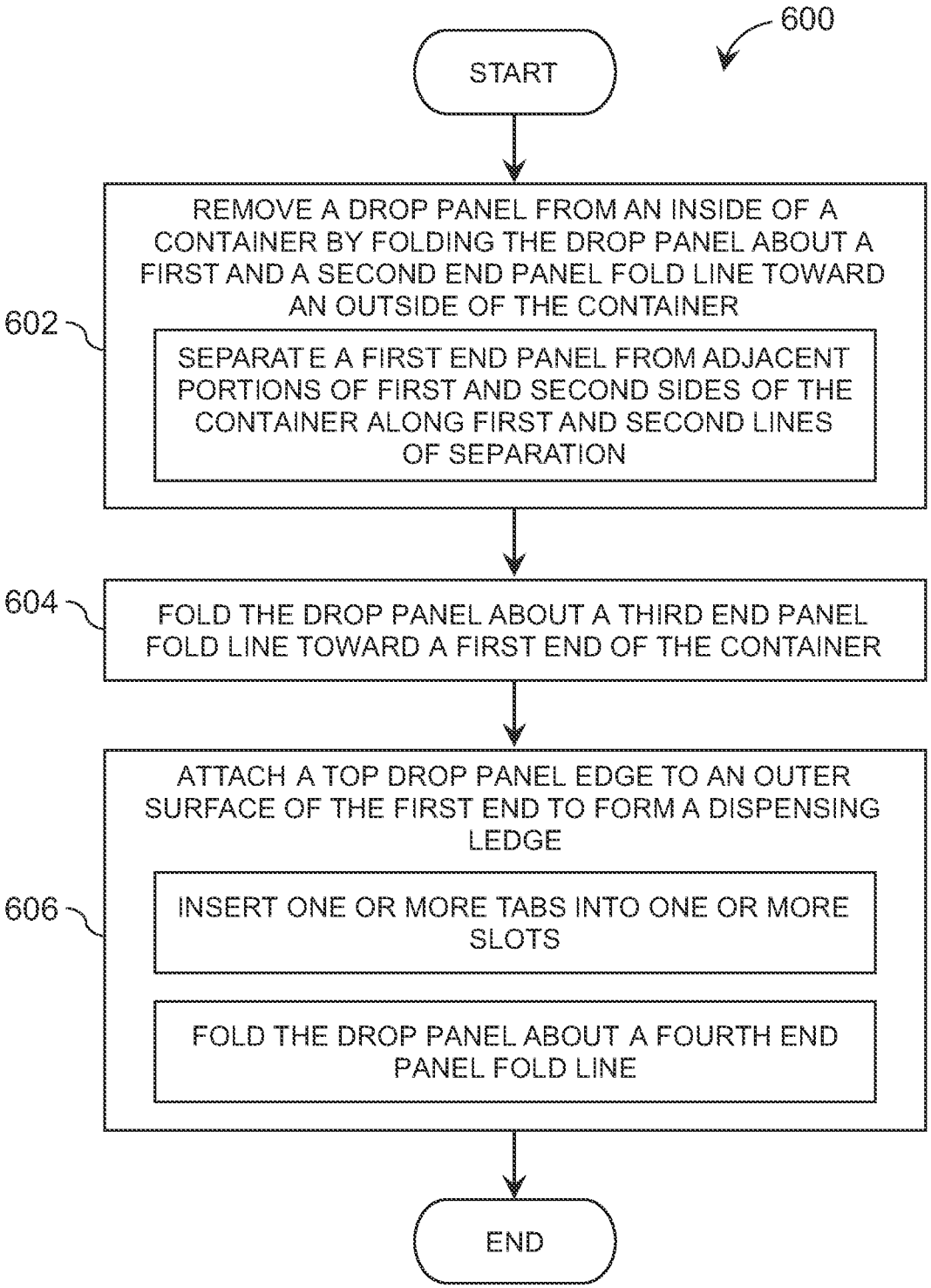
FIGS. 11 and 12 are flowcharts illustrating exemplary methods of forming a dispensing ledge in a container, in accordance with the present disclosure.

FIG. 11 illustrates a method 600 of forming a dispensing ledge in a container, in accordance with the present disclosure. With reference to the container 200 shown in FIGS. 2-6, the container 200 may comprise a first and a second side 206 and 208, a first and a second end 202 and 204, a top 212, a bottom 210, and a drop panel 100, in which the first and second ends 202 and 204 are defined by respective first and second end panels 24 and 34 (see FIG. 1A), the top 212 is defined by a plurality of top flanges 64, 66, 68, and 70 (see FIG. 1A), and the bottom 210 is defined by a plurality of bottom flanges 74, 76, 78, and 80 (see FIG. 1A). The drop panel 100 comprises a portion 24A (see FIG. 1B) of the first end panel 24 and an entirety of a first top flange 64 of the plurality of top flanges 64, 66, 68, and 70.

As shown in FIG. 11, the method 600 may begin with removing the drop panel from an inside of the container at 602. With reference to FIGS. 2-5, the drop panel 100 may be removed from an inside of the container 200 by folding the drop panel 100 about a first and a second end panel fold line 63 and 82 toward an outside of the container 200. The first top flange 64 is connected to the first end panel 24 along the first end panel fold line 63, and the second end panel fold line 82 is located between and spaced apart from the first end panel fold line 63 and a lateral edge 28 (see FIG. 1A) of the first end panel 24, in which the second end panel fold line 82 extends from a first longitudinal edge 32 to a second longitudinal edge 52 (see FIG. 1A) of the first end panel 24. A portion of the first and second longitudinal edges 32 and 52 of the first end panel extending from the second end panel fold line 82 toward the first end panel fold line 63 comprises a first and a second precut edge 84 and 86, respectively, with the first and second precut edges 84 and 86 being unconnected to adjacent portions of the first and second sides 206 and 208 of the container 200.

The method 600 in FIG. 11 may continue with folding the drop panel about a third end panel fold line toward the first end of the container at 604. With reference to FIGS. 2-5, the drop panel 100 folds about the third end panel fold line 88 toward the first end 202 of the container 200. The third end panel fold line 88 extends from the first longitudinal edge 32 to the second longitudinal edge 52 (see FIG. 1A) of the first end panel 24 and is located between and spaced apart from the first and the second end panel fold lines 63 and 82.

The method 600 in FIG. 11 may continue with attaching a top drop panel edge to an outer surface of the first end to form a dispensing ledge at 606, after which the method 600 may conclude. As shown in FIGS. 2-5, the top drop panel edge 102 is attached to an outer surface 203 of the first end 202 of the container 200 to form the dispensing ledge 214. The dispensing ledge 214 may be defined by a ledge portion 214A extending between the second and third end panel fold lines 82 and 88, in which the dispensing ledge 214 extends substantially perpendicular to the first end 202 of the container 200.

With reference to FIGS. 2 and 3, in some examples, the first end panel 24 may further comprise a first line of separation 90 extending from the first end panel fold line 63 to the first precut edge 84 and a second line of separation 92 extending from the first end panel fold line 63 to the second precut edge 86 (see also FIG. 1A). Removing the drop panel from the inside of the container at 602 in FIG. 11 may further comprise separating the first end panel from adjacent portions of the first and second sides along the first and second lines of separation. As shown in FIGS. 2 and 3, the first end panel 24 may comprise finger notches 112 located adjacent to the first and second lines of separation 90 and 92.

With reference to FIGS. 4 and 5, in some examples, the top drop panel edge 100 may comprise one or more tabs 94A and 94B and the first end 202 of the container 200 may comprise one or more slots 110A and 110B formed in a remaining portion 24B (see FIG. 1B) of the first end panel 24. Attaching the top drop panel edge to the outer surface of the first end at 606 in FIG. 11 may comprise inserting the one or more tabs into the one or more slots.

With reference to FIGS. 4 and 5, the first top flange 24 may comprise a fourth end panel fold line 116 extending from the first longitudinal edge 32 to the second longitudinal edge 52 (see FIG. 1A), in which the fourth end panel fold line 116 is spaced inward from a top edge 118 of the first top flange 24. Attaching the top drop panel edge to the outer surface of the first end of the container at 606 in FIG. 11 may further comprise folding the drop panel about the fourth end panel fold line. With continued reference to FIGS. 4 and 5, after the top drop panel edge 118 is attached to the outer surface 203 of the first end 202 of the container 200, an outer surface of a portion 101 of the drop panel 100 extending between the fourth end panel fold line 116 and the top drop panel edge 102 contacts the outer surface 203 of the first end 202 of the container 200.

Figure 7A:
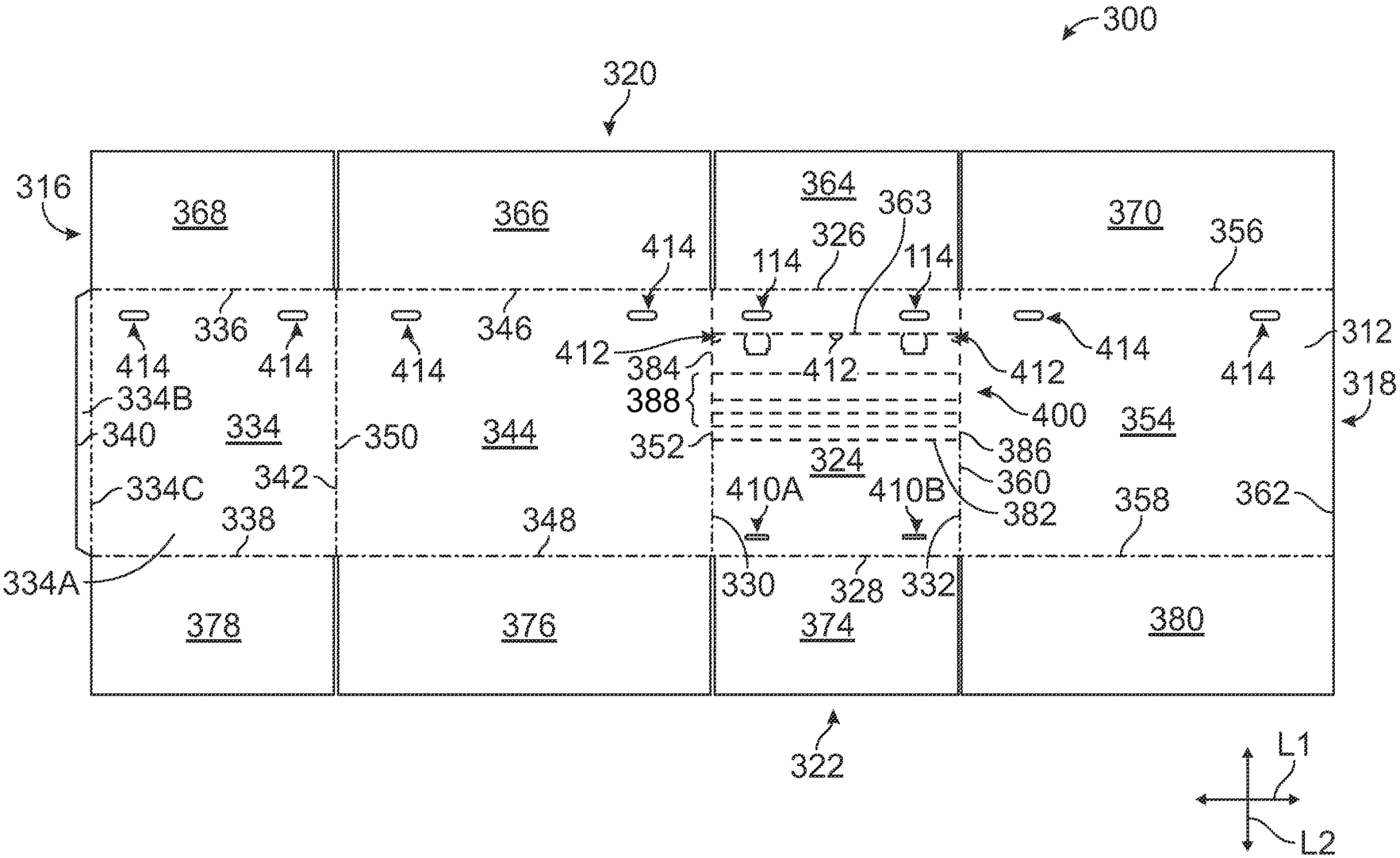
FIG. 7A is a plan view of another exemplary blank for forming a container, in accordance with the present disclosure.

Referring to FIG. 7A, a one-piece blank 300 is shown, from which another exemplary container 500 may be formed (see FIGS. 8-10) in accordance with the present disclosure. The blank 300 may be formed of corrugated fibreboard or other paperboard material and may be converted to the shape shown herein, although other materials and variations of the illustrated shape may be provided within the scope of the blanks and containers described and claimed herein. The blank 300 illustrated in FIG. 7A is a planar piece of material, in which an inner surface 312 is shown facing out of the page and an outer surface 314 (see FIG. 8) is facing an opposite direction from the inner surface 312. The blank 300 extends in a longitudinal direction $L_1$ between first and second longitudinal ends, generally designated 316 and 318, respectively, and further extends in a lateral direction $L_2$ between first and second lateral edges, generally designated 320 and 322, respectively.

Except as described herein, the blank 300 may be substantially similar to the blank 10 shown in FIGS. 1-6 and may comprise a plurality of panels and flanges connected at respective fold lines. The blank 300 may comprise a first end panel 324 having opposing first and second lateral edges 326 and 328 and opposing first and second longitudinal edges 330 and 332, and a second end panel 334 having opposing first and second lateral edges 336 and 338 and opposing first and second longitudinal edges 340 and 342. The second end panel 334 may comprise a main end panel 334A and a glue flap 334B coupled to a longitudinal edge 334C of the main end panel 334A along a fold line. The blank 300 may further comprise a first side panel 344 having opposing first and second lateral edges 346 and 348 and opposing first and second longitudinal edges 350 and 352, in which the first longitudinal edge 350 is hingedly connected to the first longitudinal edge 330 of the first end panel 324 along a fold line and the second longitudinal edge 352 is hingedly connected to the second longitudinal edge 342 of the second end panel 334 along a fold line. The blank 300 may further comprise a second side panel 354 having opposing first and second lateral edges 356 and 358 and opposing first and second longitudinal edges 360 and 362, in which the first longitudinal edge 360 is hingedly connected to the second longitudinal edge 332 of the first end panel 324 along a fold line.

With continued reference to FIG. 7A, first, second, third, and fourth top flanges 364, 366, 368, and 370 may be hingedly connected to respective ones of the first end panel 324, the first side panel 344, the second end panel 334, and the second side panel 354 along fold lines defined at the respective lateral edges 326, 346, 336, and 356 thereof. First, second, third, and fourth bottom flanges 374, 376, 378, and 380 may be hingedly connected to respective ones of the first end panel 324, the first side panel 344, the second end panel 334, and the second side panel 354 along fold lines defined at the respective lateral edges 328, 348, 338, and 358 thereof. The first and second end panels 324 and 334, the first and second side panels 344 and 354, the top flanges 364, 366, 368, and 370, and the bottom flanges 374, 376, 378, and 380 may be connected to define the container 500 (see FIG. 8), as described herein.

Figure 7B:
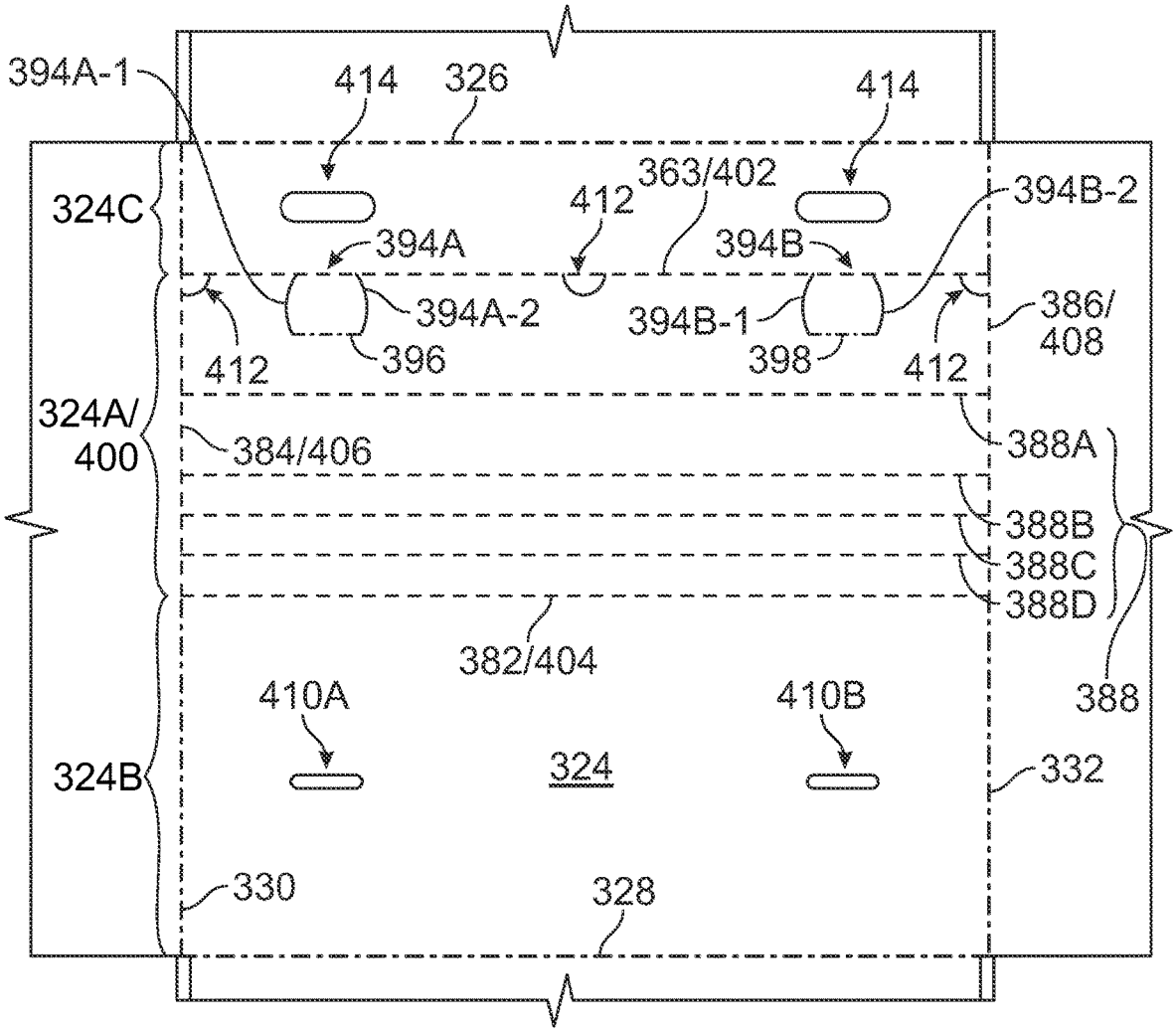
FIG. 7B is a detailed view of a portion of the blank of FIG. 7A.

The first end panel 324 may include a first line of separation 363 and a first end panel fold line 382 that each extend from the first longitudinal edge 330 of the first end panel 324 to the second longitudinal edge 332 of the first end panel 324 (see also FIG. 7B). The first line of separation 363 is spaced laterally apart from the first lateral edge 326 of the first end panel 324. The first end panel fold line 382 may be a score line and is spaced laterally apart from the second lateral edge 328 of the first end panel 324. The first end panel 324 may also include a second line of separation 384 and a third line of separation 386 defined along respective portions of the first and second longitudinal edges 330 and 332 of the first end panel 324 (see also FIG. 7B). The second and third lines of separation 384 and 386 each extend laterally from the first line of separation 363 to the first end panel fold line 382. As described herein in more detail, the first end panel 324 may further include one or more additional end panel fold lines 388 that each extend from the first longitudinal edge 330 to the second longitudinal edge 332 thereof (see also FIG. 7B). Each of the one or more additional end panel fold lines 388 may be a score line and are located between and spaced laterally apart (inward) from the first line of separation 363 and the first end panel fold line 382.

Referring to the detailed view of FIG. 7B, the blank 300 may comprise a drop panel 400 that is contained entirely within the first end panel 324A. The drop panel 400 may be comprised of a portion 324A of the first end panel 324 defined by the first, second, and third lines of separation 363, 384, and 386 and the first end panel fold line 382. The drop panel 400 has opposing top and bottom lateral edges 402 and 404, in which the top lateral edge 402 (also referred to herein as the top drop panel edge) comprises and is defined by the first line of separation 363 and the bottom lateral edge 404 comprises and is defined by the first end panel fold line 382. The drop panel 100 further has opposing first and second longitudinal edges 406 and 408, in which the first longitudinal edge 406 is comprised of and defined by a portion of the first longitudinal edge 330 of the first end panel 324 and the second longitudinal edge 408 is comprised of and defined by a portion of the second longitudinal edge 332 of the first end panel 324.

The drop panel 400 may include one or more tabs 394A and 394B extending inward from and foldably connected to the top drop panel edge 402, as shown in FIG. 7B. Each tab 394A and 394B defines a locking tab and is defined by two curved lines 394A-1, 394A-2 and 394B-1, 394B-2, respectively, which may be score lines, lines of separation, or cut lines and may extend generally laterally inward from the top drop panel edge 402, and a respective hinge connection 396 and 398 located laterally inward from the top drop panel edge 402 and extending longitudinally between inward ends (not labeled) of the respective cut lines 394A-1, 394A-2 and 394B-1, 394B-2. As shown in FIGS. 7A and 7B, the first end panel 324 may include one or more corresponding slots 410A and 410B formed in a first remaining portion 324B of the first end panel 324 that does not define the drop panel 400, i.e., the portion 324B of the first end panel 324 located between the second lateral edge 328 and the first end panel fold line 382. The slots 410A and 410B may be configured to receive a respective one of the tabs 394A and 394B upon removal and folding of the drop panel 400, as described herein (see FIGS. 8-10).

As shown in FIGS. 7A and 7B, the drop panel 400 may optionally comprise one or more finger openings or notches 412, which are provided to facilitate separation of the drop panel 400 from adjacent portions of the first end panel 324 and the first and second side panels 344 and 354, as described herein. The finger notches 412 may be located adjacent to portions of the first, second, and third lines of separation 363, 384, and 386 and may extend inward from the top drop panel edge 402 and/or from corners of the drop panel 400 defined by a junction between the top drop panel edge 402 and the longitudinal edges 406 and 408 of the drop panel 400. One or more grasping openings 414 may optionally be provided in one or more of the first end panel 324, the second end panel 334, the first side panel 344, and the second side panel 354. The grasping opening(s) 414 may be shaped to allow for handheld carrying and handling of the assembled container 500. In the example shown in FIG. 7B, the grasping openings 114 are formed in a second remaining portion 324C of the first end panel 324 that does not define the drop panel 400, i.e., the portion 324C of the first end panel 324 located between the first lateral edge 326 and the first line of separation 363.

The drop panel 400 includes one or more additional end panel fold lines 388A, 388B, 388C, and 388D (referred to herein collectively as the additional end panel fold lines 388) that are spaced laterally inward from the lateral edges 402 and 404 of the drop panel 400 and are located between and spaced apart from the first line of separation 363 and the first end panel fold line 382. In the example shown in FIG. 7B, a first additional end panel fold line 388A is spaced laterally inward from the first line of separation 363 and the tabs 394A and 394B. A second additional end panel fold line 388B is spaced laterally inward from the first additional end panel fold line 388A, i.e., toward the second lateral edge 328 of the first end panel 324, with the first additional end panel fold line 388A being located between the first line of separation 363 and the second additional end panel fold line 388B. A third additional end panel fold line 388C is spaced laterally inward from the second additional end panel fold line 388B, with the second additional end panel fold line 388B being located between the first and third additional end panel fold lines 388A and 388C. A fourth additional end panel fold line 388D is spaced laterally inward from the third additional end panel fold line 388C, with the third additional end panel fold line 388C being located between the second and fourth additional end panel fold lines 388B and 388C and the fourth additional end panel fold line 388D being located between the third additional end panel fold line 388C and the first end panel fold line 382. The second, third, and fourth additional end panel fold lines 388B, 388C, and 388D may be spaced apart from each other and from the first end panel fold line 382 by a substantially equal amount. A spacing between the first additional end panel fold line 388A and the second additional end panel fold line 388B may be greater than the spacing between the second, third, and fourth additional end panel fold lines 388B, 388C, and 388D and/or the first end panel fold line 382. Although four additional end panel fold lines 388 are shown, it may be understood that the drop panel 400 may include a different number of additional end panel fold lines, e.g., two, three, five, etc.

Figure 8:
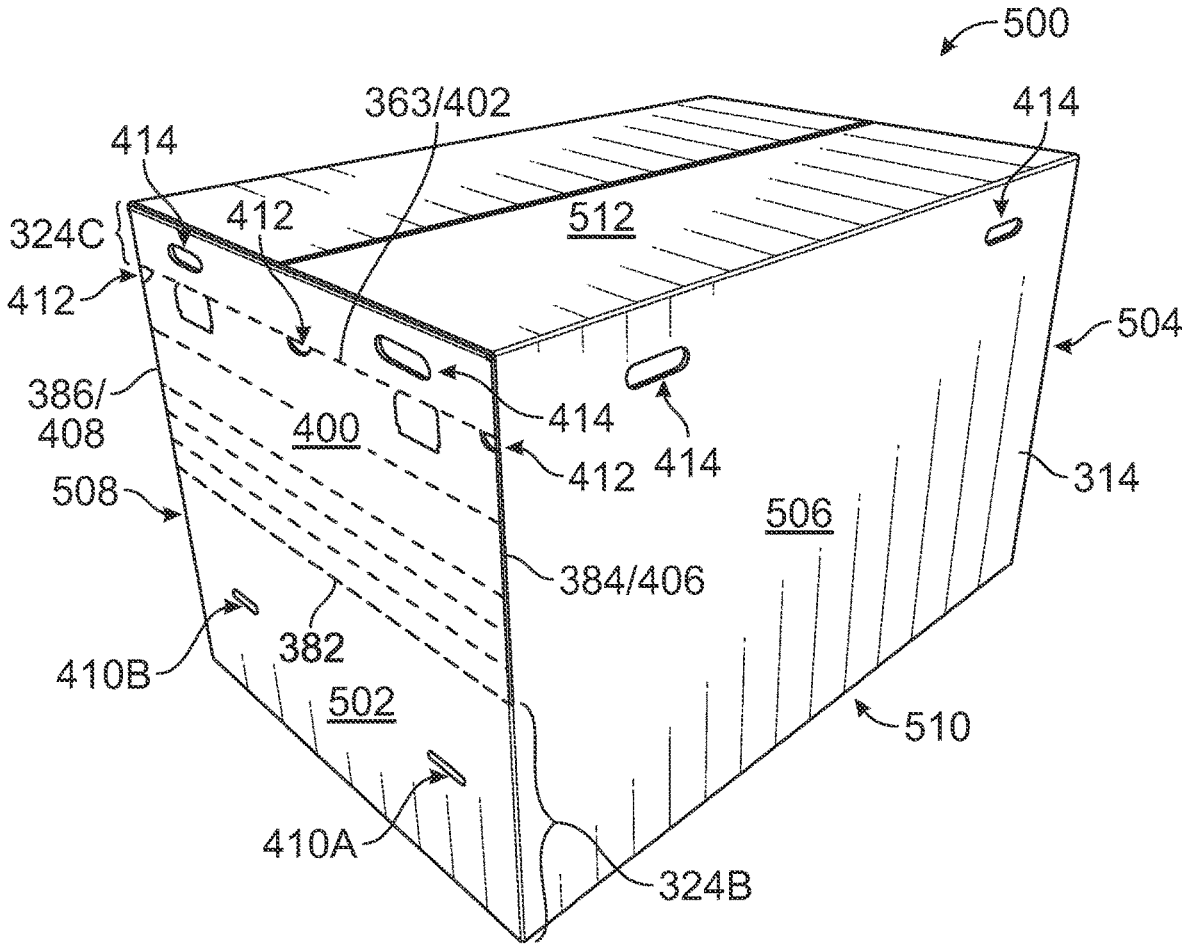
FIG. 8 is a perspective view of an exemplary assembled container, in accordance with the present disclosure.

Referring to FIGS. 7A and 8, a container 500 may be formed from the blank 300 by, for example, folding the second side panel 354 toward the first end panel 324 along the fold line at the first longitudinal edge 360 of the second side panel 354; folding the second end panel 334 toward the first side panel 344 along the fold line at the second longitudinal edge 342 of the second end panel 334; folding the second end panel 334 and the first side panel 344 together toward the first end panel 324 along the fold line at the second longitudinal edge 352 of the first side panel 344; and adhesively securing the glue flap 334B to the inner surface 312 of the blank 300 adjacent to the second longitudinal edge 362 of the second side panel 354. It may be understood that other folding sequences may be used to form the container 500. Thereafter, the container 500 may be partially erected such that the first end panel 324 extends generally 90 degrees to the first side panel 344 and the second side panel 354, the first side panel 344 extends generally 90 degrees to the second end panel 334, and the second end panel 334 extends generally 90 degrees to the second side panel 354. The first end panel 324 forms or defines a first end 502 of the container 500; the second end panel 334 forms or defines a second end 504 of the container 500 opposite the first end 502; the first side panel 344 forms or defines a first side 506 of the container 500; and the second side panel 354 forms or defines a second side 508 of the container 500 opposite the first side 506.

After the container 500 is partially erected, the first, second, third and fourth bottom flanges 374, 376, 378, and 380 may be folded inwardly so as to extend generally 90 degrees to the first and second end panels 324 and 334 and the first and second side panels 344 and 354. An exemplary sequence in which the first, second, third and fourth bottom flanges 374, 376, 378 and 380 are folded may be as follows: the first and third bottom flanges 374 and 378 are folded inwardly, after which the second and fourth bottom flanges 376 and 380 are folded over the first and third bottom flanges 374 and 378. Adhesive may be provided between adjacent overlapping portions of the bottom flanges 374, 376, 378 and 380 and/or tape may be used to secure the bottom flanges 374, 376, 378 and 380 in position. The bottom flanges 374, 376, 378 and 380 form or define a bottom 510 of the container 500.

The described container 500 may be filled with material such as a flexible sheet product that may be layered into the container 500, after the bottom flanges 374, 376, 378 and 380 have been folded and secured in position but before a top 512 of the container 500 is formed. Once the material has been added to the partially-constructed container 500, the first, second, third and fourth top flanges 364, 366, 368 and 370 may be folded inwardly so as to extend generally 90 degrees to the first and second end panels 324 and 334 and the first and second side panels 344 and 354. An exemplary sequence in which the first, second, third and fourth top flanges 364, 366, 368 and 370 are folded may be as follows: the first and third top flanges 364 and 368 are folded inwardly, after which the second and fourth top flanges 366 and 370 are folded over the first and third top flanges 364 and 368. Adhesive may be provided between adjacent overlapping portions of the top flanges 364, 366, 368, and 370 and/or tape may be used to secure the top flanges 364, 366, 368, and 370 in position. The top flanges 364, 366, 368, and 370 form or define the top 512 of the container 500.

Figure 9:
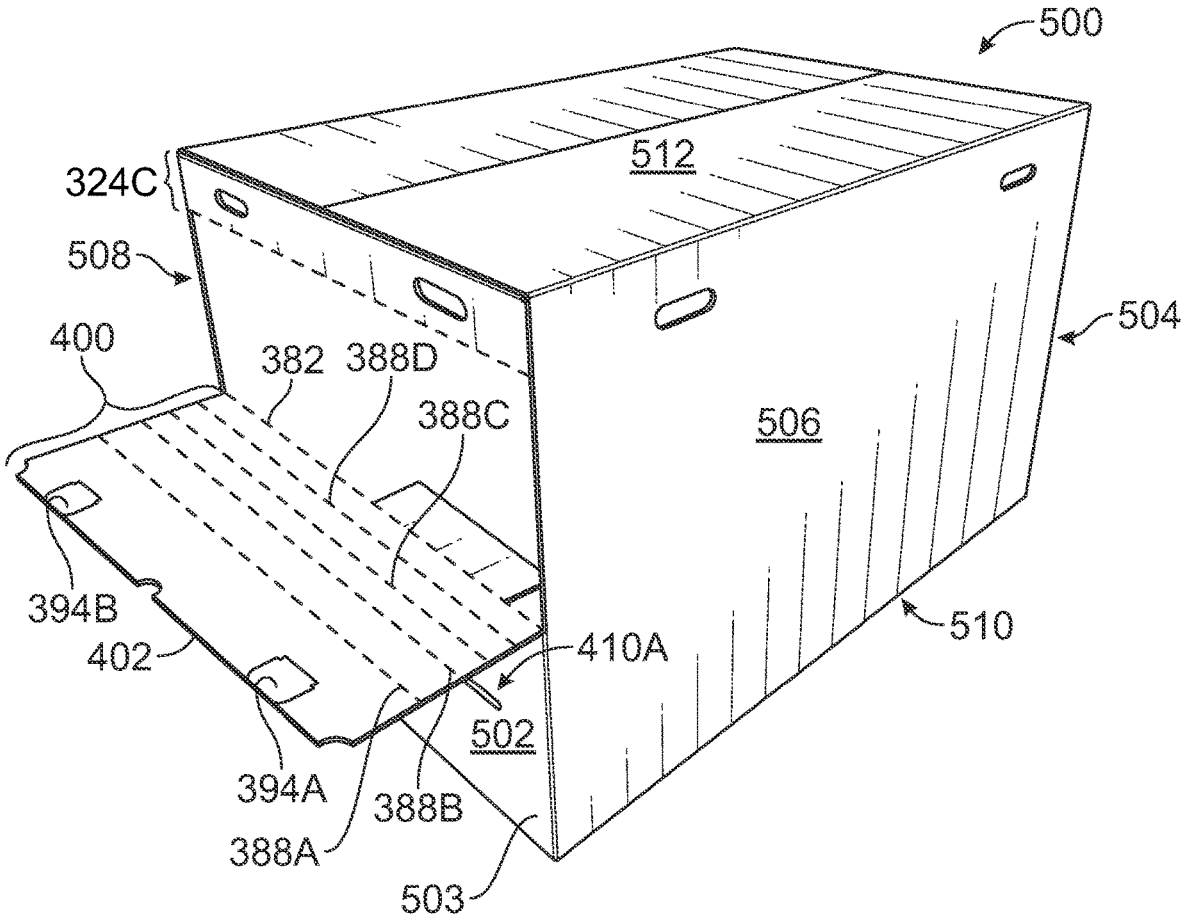
FIG. 9 is a perspective view illustrating the container of FIG. 8 with a partially assembled drop panel, in accordance with the present disclosure.

Once the container 500 is assembled and the material within the filled container 500 is ready to be dispensed, the container 500 may be opened by detaching or removing the drop panel 400 from the container 500, folding the drop panel 400, and then reattaching the drop panel 400 to the container 500. Referring to FIGS. 7B, 8, and 9, a user may grip the drop panel 400 at the top drop panel edge 402 and the longitudinal edges 406 and 408, e.g., via the finger notches 412 (when present), separate the top drop panel edge 402 from the second remaining portion 324C of the first end panel 324 along the first line of separation 363, and separate the longitudinal edges 406 and 408 of the drop panel 400 from adjacent portions of the first and second sides 506 and 508 of the container 500 along respective ones of the second and third lines of separation 384 and 386. The finger notches 112 may assist the user with locating and grasping the top drop panel edge 402 and the longitudinal edges 406 and 408 of the drop panel 100. Upon detachment of the drop panel 400, the first and second remaining portions 324B and 324C of the first end panel 324 remain in place. The user may then pull the drop panel 400 away from the first and second sides 506 and 508 of the container 500 and fold the drop panel 400 downward along the first end panel fold line 382, i.e., toward an outside of the container 500, as shown in FIG. 9.

Figure 10:
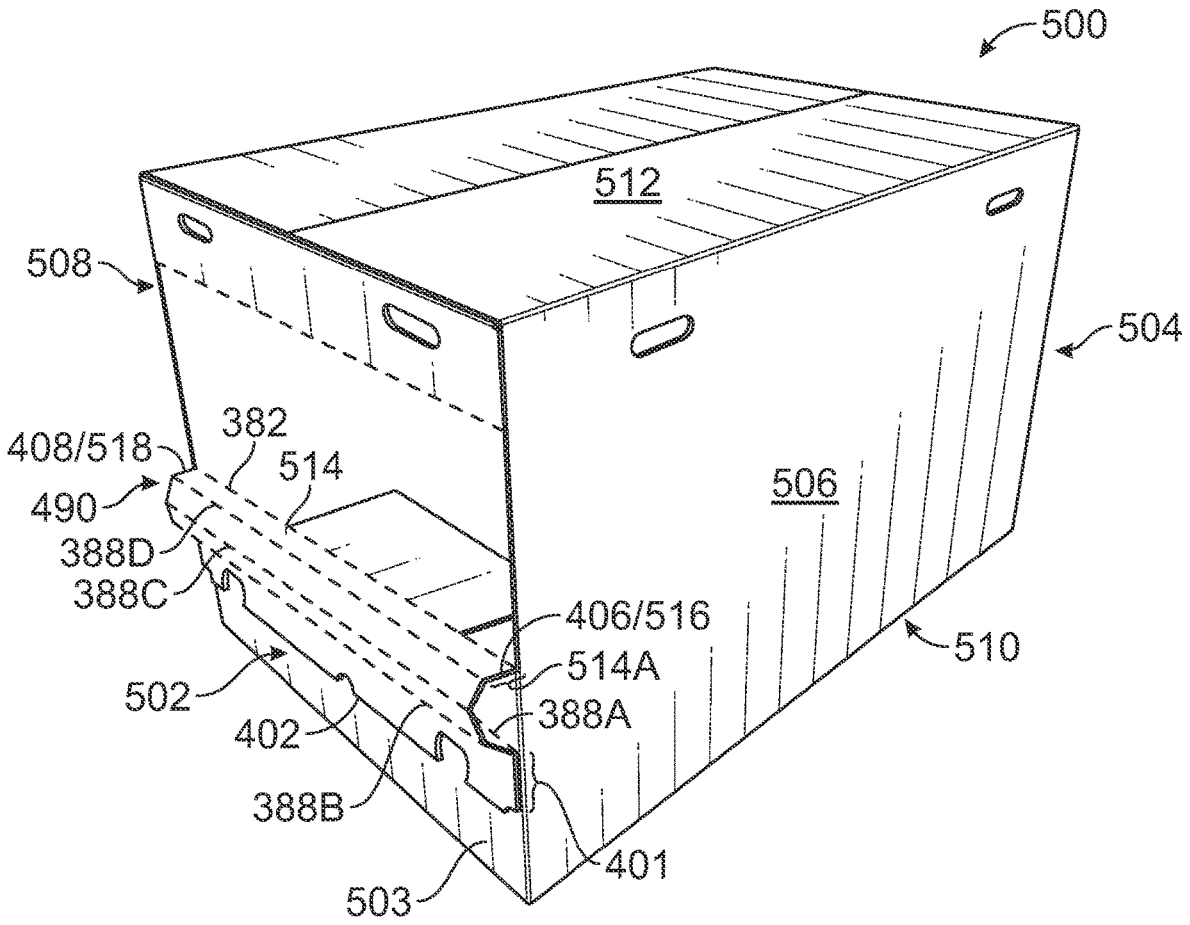
FIG. 10 is a perspective view illustrating the container of FIG. 9 with an assembled drop panel, in accordance with the present disclosure.

Referring to FIGS. 9 and 10, once the drop panel 400 is separated along the first, second, and third lines of separation 363, 384, 386, the user may form a dispensing ledge 514 by folding the drop panel 400 back towards the first end 502 of the container 500 about the first end panel fold line 382 and the one or more additional end panel fold lines 388 and attaching or connecting the top drop panel edge 402 to an outer surface 503 of the first end 502 of the container 500, e.g., by inserting the tabs 394A and 394B formed in the top drop panel edge 402 into the slots 410A and 410B (only slot 410A is visible in FIG. 9; see FIG. 8) formed in the first end 502 of the container 500. Engagement between the tabs 394A and 394B and the slots 410A and 410B helps to lock the drop panel 400 in place. The dispensing ledge 514 is defined by a ledge portion 514A extending between the first end panel fold line 382 and an adjacent one of the additional end panel fold lines, i.e., the fourth additional end panel fold line 388D. The dispensing ledge 514 may have opposing inner and outer edges (not separately labeled) defined by the first end panel fold line 382 and the fourth additional end panel fold line 388D, and opposing side edges 516 and 518 defined by portions of the longitudinal edges 406 and 408 of the drop panel 400. The top drop panel edge 402 may be spaced apart from a plane (not shown) defined by the bottom 510 of the container 500.

With reference to FIG. 10, when the top drop panel edge 402 is connected to the outer surface 503 of the first end 502 of the container 500, the drop panel 400 may fold about one of the additional end panel fold lines, i.e., the first additional end panel fold line 388A (see also FIG. 9), adjacent to the top drop panel edge 402, such that an outer surface (not visible) of a portion 401 of the drop panel 400 extending between the first additional end panel fold line 388A and the top drop panel edge 402 contacts and is parallel with an adjacent or underlying portion of the outer surface 503 of the first end 502 of the container 500. In the example shown in FIG. 10, folding the drop panel 400 about the first, second, third, and fourth additional end panel fold lines 388A, 388B, 388C, and 388D may create a curved section 490 of the drop panel 400 that extends outward from the first end 502 of the container 500.

After the container 500 is opened and the dispensing ledge 514 is formed, a product (not shown; see FIG. 6), such as a flexible sheet product, may be dispensed directly from the container 500 by grasping a first end of the product and pulling the product out of the container 500, as described in detail above with respect to FIG. 6. Similar to the dispensing ledge 214, the dispensing ledge 514 shown in FIG. 10 supports the product and allows the product to dispense smoothly over the dispensing ledge 514. The curved section 490 of the dispensing ledge 514 may further help to facilitate smooth dispensing of the product and prevent tearing, jamming, or other damage. The blank 300 and the container 500 formed therefrom may be sized to accommodate a product having any desired size, as described above.

Figure 12:
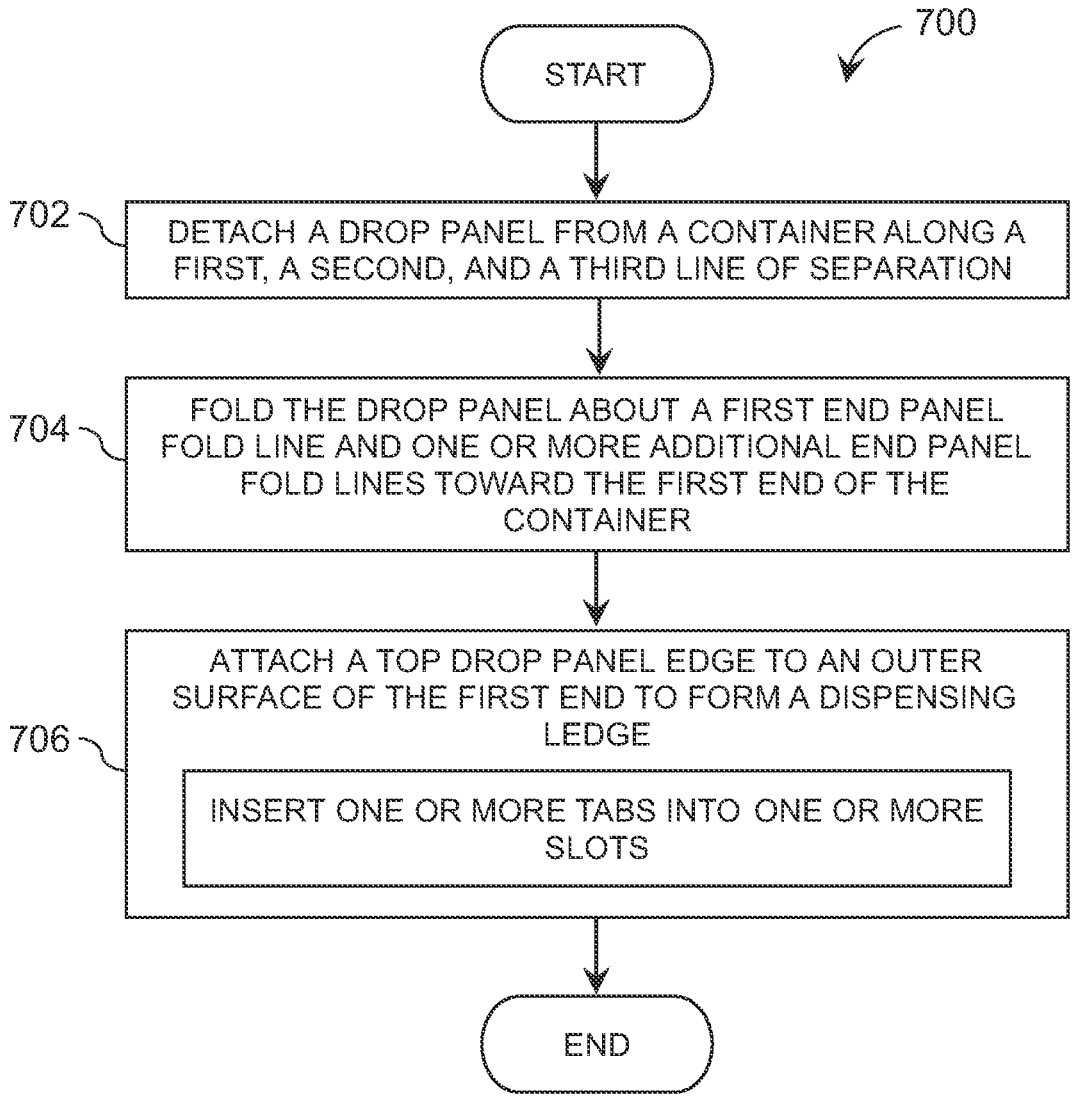

FIG. 12 illustrates a method 700 of forming a dispensing ledge in a container, in accordance with the present disclosure. With reference to the container 500 shown in FIGS. 8-10, the container 500 may comprise a first and a second side 506 and 508, a first and a second end 502 and 504, a top 512, a bottom 510, and a drop panel 400, in which the first and second ends 502 and 504 are defined by respective first and second end panels 324 and 334 (see FIG. 7A), the top 512 is defined by a plurality of top flanges 364, 366, 368, and 370 (see FIG. 7A), and the bottom 510 is defined by a plurality of bottom flanges 374, 376, 378, 380. The drop panel 400 comprises a portion 324A of the first end panel 324 (see FIG. 7B).

As shown in FIG. 12, the method 700 may begin with detaching the drop panel from the container along a first, a second, and a third line of separation at 702. With reference to FIGS. 8 and 9, the drop panel 400 may be detached from the container 500 along the first, second, and third lines of separation 363, 384, and 386. The first line of separation 363 extends from a first longitudinal edge 330 to a second longitudinal edge 332 (see FIG. 7A) of the first end panel 324 and is spaced apart from a first lateral edge 326 (see FIG. 7A) of the first end panel 324. The second and third lines of separation 384 and 386 are defined along respective portions of the first and second longitudinal edges 330 and 332 (see FIG. 7A) of the first end panel 324 and each extend from the first line of separation 363 to a first end panel fold line 382. The first end panel fold line 382 extends from the first longitudinal edge 330 to the second longitudinal edge 332 (see FIG. 7A) of the first end panel 324 and is spaced apart from a second lateral edge 328 (see FIG. 7A) of the first end panel 324. The first end panel 324 may comprise finger notches 412 located adjacent to the first, second, and third lines of separation 363, 384, and 386.

The method 700 in FIG. 12 may continue with folding the drop panel about the first end panel fold line and one or more additional end panel fold lines toward the first end of the container at 704. With reference to FIGS. 8-10, the drop panel 400 is folded about the first end panel fold line 382 and one or more additional end panel fold lines 388 toward the first end 502 of the container 500. The one or more additional end panel fold lines 388, e.g., first, second, third, and fourth additional end panel fold lines 388A, 388B, 388C, and 388D, each extend from the first longitudinal edge 330 to the second longitudinal edge 332 (see FIG. 7A) of the first end panel 324 and are spaced apart from the first line of separation 363 and the first end panel fold line 382.

The method 700 in FIG. 12 may continue with attaching a top drop panel edge to an outer surface of the first end of the container to form a dispensing ledge at 706, after which the method may conclude. With reference to FIGS. 9 and 10, the top drop panel edge 402 is attached to the outer surface 503 of the first end 502 of the container 500 to form the dispensing ledge 514. The dispensing ledge 514 is defined by a ledge portion 514A extending between the first end panel fold line 382 and an adjacent one of the one or more additional end panel fold lines, i.e., the fourth additional end panel fold line 388D.

As shown in FIG. 10, after the top drop panel edge 402 is attached to the outer surface 503 of the first end 502 of the container 500, the drop panel 400 folds about one of the one or more additional end panel fold lines, i.e. the first additional end panel fold line 388A, adjacent to the top drop panel edge 402, such that an outer surface of a portion 401 of the drop panel 400 extending between the one additional end panel fold line 388A and the top drop panel edge 402 contacts the outer surface 503 of the first end 502 of the container 500. Folding the drop panel 400 about the additional end panel fold lines 388A, 388B, 388C, and/or 388D as described herein and attaching the top drop panel edge 402 to the outer surface 502 of the first end 502 of the container 500 creates a curved section 490 of the drop panel 400 that extends outward from the first end 502 of the container 500.

With reference to FIGS. 8-10, in some examples, the top drop panel edge 402 comprises one or more tabs 394A and 394B and the first end 502 of the container 500 comprises one or more slots 410A, 410B formed in a remaining portion 324B of the first end panel 324. Attaching the top drop panel edge to the outer surface of the first end at 706 in FIG. 12 may comprise inserting the one or more tabs into the one or more slots.

While particular examples of blanks and containers in accordance with the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A container comprising:

a first and a second side panel, a first and a second end panel, a plurality of top flanges, and a plurality of bottom flanges, wherein the panels and flanges are connected to define the container; and a drop panel comprising a portion of the first end panel and an entirety of a first top flange of the plurality of top flanges, wherein the first top flange is connected to the first end panel along a first end panel fold line, the portion of the first end panel being defined by the first end panel fold line and:

a second end panel fold line extending from a first longitudinal edge to a second longitudinal edge of the first end panel, the second end panel fold line being located between and spaced apart from the first end panel fold line and a lateral edge of the first end panel, and a first and a second precut edge defined by respective portions of the first and second longitudinal edges of the first end panel, the first and the second precut edge each extending from the second end panel fold line toward the first end panel fold line;

wherein the first end panel further comprises a third end panel fold line extending from the first longitudinal edge to the second longitudinal edge, the third end panel fold line being located between and spaced apart from the first and the second end panel fold lines;

wherein the first end panel defines a first end of the container; and when the container is assembled, a dispensing ledge is formed by folding the drop panel about the first, second, and third end panel fold lines toward an outside of the container and connecting a top drop panel edge to an outer surface of the first end of the container, wherein the dispensing ledge is defined by a ledge portion extending between the second and third end panel fold lines, the dispensing ledge extending substantially perpendicular to the first end of the container.

2. The container of claim 1, wherein the top drop panel edge comprises one or more tabs that are received in one or more slots formed in a remaining portion of the first end panel to attach the top drop panel edge to the outer surface of the first end of the container.

3. The container of claim 1, wherein the first end panel further comprises a first and a second line of separation defined along respective portions of the first and second longitudinal edges, the first line of separation extending from the first end panel fold line to the first precut edge, and the second line of separation extending from the first end panel fold line to the second precut edge, wherein the dispensing ledge is formed by separating the first end panel from adjacent portions of the first and second side panels along the first and second lines of separation.

4. The container of claim 3, wherein the first end panel comprises finger notches located adjacent to the first and second lines of separation.

5. The container of claim 1, wherein one or more of the first side panel, the second side panel, the first end panel, and the second end panel comprise at least one grasping opening, the grasping opening being shaped to allow for handling of the container.

6. The container of claim 1, wherein the first top flange comprises a fourth end panel fold line extending from a first longitudinal edge to a second longitudinal edge, the fourth end panel fold line being spaced inward from a top edge of the first top flange, wherein after the top drop panel edge is connected to the outer surface of the first end of the container, an outer surface of a portion of the drop panel extending between the fourth end panel fold line and the top drop panel edge contacts the outer surface of the first end of the container.

7. A method of forming a dispensing ledge in a container, the container comprising a first and a second side, a first and a second end, a top, a bottom, and a drop panel, wherein the first and second ends are defined by respective first and second end panels, wherein the top is defined by a plurality of top flanges, wherein the bottom is defined by a plurality of bottom flanges, and the drop panel comprises a portion of the first end panel and an entirety of a first top flange of the plurality of top flanges, the method comprising:

removing the drop panel from an inside of the container by folding the drop panel about a first and a second end panel fold line toward an outside of the container, wherein the first top flange is connected to the first end panel along the first end panel fold line, wherein the second end panel fold line is located between and spaced apart from the first end panel fold line and a lateral edge of the first end panel, the second end panel fold line extending from a first longitudinal edge to a second longitudinal edge of the first end panel, wherein a portion of the first and second longitudinal edges of the first end panel extending from the second end panel fold line toward the first end panel fold line comprises a first and a second precut edge, respectively, the first and second precut edges being unconnected to adjacent portions of the first and second sides of the container;

folding the drop panel about a third end panel fold line toward the first end of the container, wherein the third end panel fold line extends from the first longitudinal edge to the second longitudinal edge of the first end panel, the third end panel fold line being located between and spaced apart from the first and the second end panel fold lines; and attaching a top drop panel edge to an outer surface of the first end to form a dispensing ledge, the dispensing ledge being defined by a ledge portion extending between the second and third end panel fold lines, wherein the dispensing ledge extends substantially perpendicular to the first end of the container.

8. The method of claim 7, wherein the top drop panel edge comprises one or more tabs and the first end of the container comprises one or more slots formed in a remaining portion of the first end panel, and wherein attaching the top drop panel edge to the outer surface of the first end comprises:

inserting the one or more tabs into the one or more slots.

9. The method of claim 7, wherein the first end panel further comprises a first line of separation extending from the first end panel fold line to the first precut edge, and a second line of separation extending from the first end panel fold line to the second precut edge, and wherein removing the drop panel from the inside of the container further comprises:

separating the first end panel from adjacent portions of the first and second sides along the first and second lines of separation.

10. The method of claim 9, wherein the first end panel comprises finger notches located adjacent to the first and second lines of separation.

11. The method of claim 7, wherein the first top flange comprises a fourth end panel fold line extending from the first longitudinal edge to the second longitudinal edge, the fourth end panel fold line being spaced inward from a top edge of the first top flange, wherein attaching the top drop panel edge to the outer surface of the first end of the container further comprises:

folding the drop panel about the fourth end panel fold line, wherein after the top drop panel edge is attached to the outer surface of the first end of the container, an outer surface of a portion of the drop panel extending between the fourth end panel fold line and the top drop panel edge contacts the outer surface of the first end of the container.

12. A blank for forming a container, the blank comprising:

a first end panel and a second end panel each having opposing longitudinal edges and opposing lateral edges;

a first side panel hingedly connected to one of the longitudinal edges of the first end panel and one of the longitudinal edges of the second end panel;

a second side panel hingedly connected to the other of the longitudinal edges of the first end panel;

a plurality of top flanges; and a plurality of bottom flanges, wherein a first top flange of the plurality of top flanges is hingedly connected to one of the lateral edges of the first end panel along a first end panel fold line, wherein the first end panel comprises:

a second end panel fold line extending between the opposing longitudinal edges thereof, the second end panel fold line being located between and spaced apart from the first end panel fold line and a first lateral edge of the opposing lateral edges of the first end panel, a third end panel fold line extending between the opposing longitudinal edges thereof, the third end panel fold line being located between and spaced apart from the first and the second end panel fold lines, and a first and a second precut edge defined by respective portions of the opposing longitudinal edges thereof, the first and the second precut edge each extending from the second end panel fold line toward the first end panel fold line, wherein the opposing longitudinal edges of the first end panel are unconnected to the first and second side panels along the first and second precut edges.

13. The blank of claim 12, wherein a top edge of the first top flange comprises one or more tabs foldably connected to the first top flange and wherein the first end panel comprises one or more slots formed between the second end panel fold line and the first lateral edge of the first end panel.

14. The blank of claim 12, wherein the first end panel further comprises a first and a second line of separation defined by respective portions of the opposing longitudinal edges of the first end panel, the first line of separation extending from the first end panel fold line to the first precut edge and the second line of separation extending from the first end panel fold line to the second precut edge.

15. The blank of claim 14, wherein the first end panel further comprises finger notches extending inward from the opposing longitudinal edges thereof, the finger notches being located adjacent to the first and second lines of separation.

16. The blank of claim 12, wherein the first top flange comprises a fourth end panel fold line extending between opposing longitudinal edges thereof, the fourth end panel fold line being spaced inward from a top edge of the first top flange.

17. A container comprising:

a first and a second side panel, a first and a second end panel, a plurality of top flanges, and a plurality of bottom flanges, wherein the panels and flanges are connected to define the container; and a drop panel comprising a portion of the first end panel, the drop panel being defined by:

a first line of separation extending from a first longitudinal edge to a second longitudinal edge of the first end panel, the first line of separation being spaced apart from a first lateral edge of the first end panel;

a first end panel fold line extending from the first longitudinal edge to the second longitudinal edge, the first end panel fold line being spaced apart from a second lateral edge of the first end panel; and a second line of separation and a third line of separation defined along respective portions of the first and second longitudinal edges of the first end panel, wherein the second and third lines of separation each extend from the first line of separation to the first end panel fold line, wherein the first end panel further comprises one or more additional end panel fold lines extending from the first longitudinal edge to the second longitudinal edge, each of the one or more additional end panel fold lines being located between and spaced apart from the first line of separation and the first end panel fold line;

wherein the first end panel defines a first end of the container; and when the container is assembled, a dispensing ledge is formed by separating the drop panel along the first, second, and third lines of separation, folding the drop panel about the first end panel fold line and the one or more additional end panel fold lines, and attaching a top drop panel edge to an outer surface of the first end of the container, wherein the dispensing ledge is defined by a ledge portion extending between the first end panel fold line and an adjacent one of the one or more additional end panel fold lines.

18. The container of claim 17, wherein the top drop panel edge comprises one or more tabs that are received in one or more slots formed in a remaining portion of the first end panel to attach the top drop panel edge to the outer surface of the first end of the container.

19. The container of claim 17, wherein the drop panel comprises finger notches located adjacent to the first, second, and third lines of separation.

20. The container of claim 17, wherein after the top drop panel edge is attached to the outer surface of the first end of the container, an outer surface of a portion of the drop panel extending between the top drop panel edge and an adjacent one of the one or more additional end panel fold lines contacts the outer surface of the first end of the container.

21. A method of forming a dispensing ledge in a container, the container comprising a first and a second side, a first and a second end, a top, a bottom, and a drop panel, wherein the first and second ends are defined by respective first and second end panels, wherein the top is defined by a plurality of top flanges, wherein the bottom is defined by a plurality of bottom flanges, and the drop panel comprises a portion of the first end panel, the method comprising:

detaching the drop panel from the container along a first, a second, and a third line of separation, wherein the first line of separation extends from a first longitudinal edge to a second longitudinal edge of the first end panel and is spaced apart from a first lateral edge of the first end panel, wherein the second and third lines of separation are defined along respective portions of the first and second longitudinal edges of the first end panel and each extend from the first line of separation to a first end panel fold line, wherein the first end panel fold line extends from the first longitudinal edge to the second longitudinal edge of the first end panel and is spaced apart from a second lateral edge of the first end panel;

folding the drop panel about the first end panel fold line and one or more additional end panel fold lines toward the first end of the container, wherein the one or more additional end panel fold lines each extend from the first longitudinal edge to the second longitudinal edge of the first end panel and are spaced apart from the first line of separation and the first end panel fold line; and attaching a top drop panel edge to an outer surface of the first end of the container to form a dispensing ledge, the dispensing ledge being defined by a ledge portion extending between the first end panel fold line and an adjacent one of the one or more additional end panel fold lines.

22. The method of claim 21, wherein the top drop panel edge comprises one or more tabs and the first end of the container comprises one or more slots formed in a remaining portion of the first end panel, and wherein attaching the top drop panel edge to the outer surface of the first end comprises:

inserting the one or more tabs into the one or more slots.

23. The method of claim 21, wherein the first end panel comprises finger notches located adjacent to the first, second, and third lines of separation.

24. The method of claim 21, wherein after the top drop panel edge is attached to the outer surface of the first end of the container, the drop panel folds about one of the one or more additional end panel fold lines adjacent to the top drop panel edge, such that an outer surface of a portion of the drop panel extending between the one additional end panel fold line and the top drop panel edge contacts the outer surface of the first end of the container.

25. The method of claim 21, wherein the one or more additional end panel fold lines comprise a plurality of additional end panel fold lines, and wherein folding the drop panel about the plurality of additional end panel fold lines and attaching the top drop panel edge to the outer surface of the first end of the container creates a curved section of the drop panel that extends outward from the first end of the container.

26. A blank for forming a container, the blank comprising:

a first end panel and a second end panel each having opposing first and second longitudinal edges and opposing first and second lateral edges;

a first side panel hingedly connected to one of the longitudinal edges of the first end panel and one of the longitudinal edges of the second end panel;

a second side panel hingedly connected to the other of the longitudinal edges of the first end panel;

a plurality of top flanges; and a plurality of bottom flanges, wherein a first top flange of the plurality of top flanges comprises:

a first line of separation extending between the first and second longitudinal edges thereof, the first line of separation being spaced apart from the first lateral edge;

a first end panel fold line extending between the first and second longitudinal edges thereof, the first end panel fold line being spaced apart from the second lateral edge;

a second line of separation and a third line of separation defined along respective portions of the first and second longitudinal edges thereof, wherein the second and third lines of separation each extend from the first line of separation to the first end panel fold line; and one or more additional end panel fold lines each extending from the first longitudinal edge to the second longitudinal edge thereof, wherein the at least one additional end panel fold lines are located between and spaced apart from the first line of separation and the first end panel fold line.

27. The blank of claim 26, wherein a top edge of the first top flange comprises one or more tabs foldably connected to the first top flange and wherein the first end panel comprises one or more slots formed between the first end panel fold line and the first lateral edge of the first end panel.

28. The blank of claim 26, wherein the first end panel further comprises finger notches located adjacent to the first, second, and third lines of separation.

* * * * *